US007507190B2

(12) United States Patent
Piane, Jr.

(10) Patent No.: US 7,507,190 B2
(45) Date of Patent: Mar. 24, 2009

(54) EXERCISE APPARATUS

(75) Inventor: Robert A. Piane, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 0 days.

(21) Appl. No.: 11/881,678

(22) Filed: Jul. 27, 2007

(65) Prior Publication Data

US 2007/0270291 A1 Nov. 22, 2007

Related U.S. Application Data

(63) Continuation-in-part of application No. 11/176,551, filed on Jul. 6, 2005, now abandoned, which is a continuation-in-part of application No. 11/135,226, filed on May 23, 2005, now abandoned, which is a continuation-in-part of application No. 10/912,258, filed on Aug. 5, 2004, now abandoned, and a continuation-in-part of application No. 10/987,376, filed on Nov. 12, 2004, which is a continuation-in-part of application No. 10/736,807, filed on Dec. 15, 2003, now abandoned.

(51) Int. Cl.
*A63B 21/062* (2006.01)
*A63B 21/02* (2006.01)

(52) U.S. Cl. ..... 482/99; 482/123

(58) Field of Classification Search ..... 482/99–104, 482/94, 135–139
See application file for complete search history.

(56) References Cited

U.S. PATENT DOCUMENTS 4,198,045 A 4/1980 Miller
4,272,074 A 6/1981 Sferle
4,357,010 A 11/1982 Telle
4,358,107 A 11/1982 Nissen
4,511,137 A 4/1985 Jones
4,564,194 A * 1/1986 Dawson ..... 482/102
4,592,545 A 6/1986 Sagedahl et al.
4,645,197 A 2/1987 McFee
4,733,859 A 3/1988 Kock et al.
4,822,037 A 4/1989 Makansi et al.
4,919,418 A * 4/1990 Miller ..... 482/6
4,981,294 A 1/1991 Dalebout et al.
4,988,095 A 1/1991 Ferrari
5,015,926 A 5/1991 Casler
5,016,871 A 5/1991 Dalebout et al.
5,029,849 A 7/1991 Nurkowski
5,050,872 A * 9/1991 Farenholtz ..... 482/133
5,117,170 A 5/1992 Keane et al.
5,163,888 A 11/1992 Stearns
5,209,461 A 5/1993 Whightsil, Sr.
5,211,613 A 5/1993 Friesl
5,213,556 A 5/1993 Boren
5,311,827 A 5/1994 Greene (Continued)

*Primary Examiner*—Fenn C Mathew
(74) *Attorney, Agent, or Firm*—Milde & Hoffberg, LLP

(57) ABSTRACT

Exercise apparatus, for example of the type disclosed in the U.S. Pat. No. 6,705,976, is provided with a resistance source for exerting a counterforce to the force applied by the user. This resistance source includes at least two of (1) means, such as a cylindrical rod or the like, for removably holding one or more weights, (2) at least one hook or the like for removably attaching one or more springs, and (3) means for removably attaching one or more damping devices.

20 Claims, 27 Drawing Sheets

U.S. PATENT DOCUMENTS 5,346,448 A 9/1994 Sollo
5,387,170 A 2/1995 Rawls et al.
5,387,171 A 2/1995 Casey et al.
5,400,721 A 3/1995 Greene
5,433,678 A 7/1995 Chi
5,512,029 A 4/1996 Barnard et al.
5,549,533 A * 8/1996 Olson et al. ..... 482/137
5,583,403 A 12/1996 Anjanappa et al.
5,643,146 A 7/1997 Stark et al.
5,643,153 A 7/1997 Nylen et al.
5,653,667 A 8/1997 Reyes
5,738,611 A 4/1998 Ehrenfried et al.
5,776,038 A * 7/1998 Hazelwood ..... 482/92
5,836,859 A 11/1998 Van Herle
5,891,004 A 4/1999 Berry
5,897,470 A 4/1999 Chen
5,938,574 A 8/1999 Webber
5,971,897 A 10/1999 Olson et al.
6,066,074 A 5/2000 Marcinkiewicz
6,165,110 A 12/2000 Gajda
6,312,365 B1 11/2001 Koenig
6,458,060 B1 10/2002 Watterson et al.
6,561,956 B1 5/2003 Allison
6,669,609 B2 * 12/2003 Gerschefske et al. ..... 482/123
6,705,976 B1 3/2004 Piane, Jr.
6,755,770 B2 * 6/2004 Martens ..... 482/99
7,014,599 B2 * 3/2006 Ashley ..... 482/110
7,101,326 B2 * 9/2006 Gerschefske et al. ..... 482/129
7,192,389 B2 3/2007 Allison
7,229,391 B2 * 6/2007 Francis ..... 482/127
2001/0034290 A1 10/2001 Tolles
2002/0016237 A1 2/2002 Schmidt
2002/0025891 A1 2/2002 Colosky, Jr. et al.
2002/0077229 A1 6/2002 McBride
2002/0088910 A1 7/2002 Sweere et al.
2002/0103058 A1 8/2002 Webber
2002/0142893 A1 10/2002 Koenig
2003/0096681 A1 5/2003 Myers et al.
2004/0058786 A1 3/2004 Nerio et al.
2006/0063649 A1 3/2006 Allison

* cited by examiner

EXERCISE APPARATUS

CROSS-REFERENCE TO RELATED APPLICATIONS

This present application is a continuation-in-part of U.S. patent application Ser. No. 11/176,551 filed Jul. 6, 2005, now abandoned entitled "EXERCISE APPARATUS", which application, in turn, is a continuation-in-part of U.S. patent application Ser. No. 11/135,226, filed May 23, 2005, now abandoned entitled "EXERCISE APPARATUS", which application, in turn, is a continuation-in-part of U.S. patent application Ser. No. 10/912,258, filed Aug. 5, 2004, now abandoned entitled "EXERCISE APPARATUS" and U.S. patent application Ser. No. 10/987,376, filed Nov. 12, 2004, entitled "EXERCISE APPARATUS USING WEIGHTS FOR HIGH-SPEED TRAINING", which is a continuation-in-part of U.S. patent application Ser. No. 10/736,807, filed Dec. 15, 2003, now abandoned entitled "EXERCISE APPARATUS USING WEIGHTS FOR HIGH-SPEED TRAINING".

BACKGROUND OF THE INVENTION

The present invention relates to body exercise equipment. More particularly, the present invention relates to exercise equipment such as that disclosed in the U.S. Pat. No. 6,705,976, the subject matter of which is incorporated herein by reference.

The human body moves primarily in circular or arcuate paths of motion, as evidenced by Leonardo Da Vinci's study of human proportions. From a biomedical standpoint, exercise equipment designed with resistance delivery systems oriented along an arced pathway are inherently more biomechanically optimized than those that are not. The aforesaid U.S. patent discloses two embodiments of exercise equipment of this type.

A first embodiment encloses a housing having a structural surface defining a prescribed concave arcuate contour having a number of cable exit points positioned along this surface. A number of cables, each having a proximal end and a distal end, are arranged such that the proximal end passes through one of the exit points and is attached to a gripping device, such as a handle, that enables the user to exert a tensile force in the cable by pulling the handle. The distal end of each cable is coupled to a common source of resistance such that, when the proximal end of each cable is pulled by a user, the source of resistance exerts a counterforce on the cable. Means are provided for retaining each cable in a retracted position when it is not being pulled by a user, even when one or more other cables is or are pulled by the user.

In a second embodiment, the exercise equipment comprises a frame having a track extending along a prescribed concave arcuate path. A moveable trolly, having an exit point for a cable, is repositionable to a number of fixed positions along the track. A single cable has a proximal end which extends through the exit point and is attached to a gripping device, such as a handle, that enables a user to exert a tensile force on the cable. The distal end of this cable is coupled to a source of resistance. Cable takeup means are provided, in the exercise equipment, for maintaining the length of the cable between its proximal end and the exit point through which it passes substantially constant, independent of the position of the trolley, and thus the exit point, along the track, when no tensile force is applied by the user.

While the exercise apparatus disclosed in the aforementioned U.S. Pat. No. 6,705,976 operates extremely well for the purpose for which it is intended, this and other exercise equipment of this type is relatively expensive to manufacture and to transport. One of the significant costs of this equipment involves the source of resistance applied to the cable or cables used in the machine. This source of resistance comprises, as a minimum, a plurality of weights which form a "weight stack" that is coupled to the distal end of the cable(s) and is lifted vertically when the proximal end of a cable is pulled by a user.

Weight stacks, which are normally guided by rods or rails to run vertically, include a device for selecting the number of weights in the stack that are to be lifted as a unit by the user. The weights that are not selected remain in the lower part of the stack while the selected weights are lifted upward.

With a mechanism of this type, it is difficult to obtain a "starting resistance" or minimum resistance of less than five pounds because, even if no weights are selected, the device for selecting the weights, itself, has a minimum weight. Particularly in the case of physical therapy applications, and for the severely de-conditioned or elderly persons, it is useful to be able to set the lowest resistance weight to zero, or near zero.

As noted above, a further disadvantage of this exercise equipment is that the weights incorporated into the weight stack present a significant cost to manufacture and transport. Also, the rods or rails, and the mechanism for selecting the weights to be lifted, add to the cost of the equipment. Furthermore, the cost of shipping the weights, rods, rails and mechanism for selecting the weights is not inconsiderable.

SUMMARY OF THE INVENTION

It is an object of the present invention to provide exercise apparatus, of the type that usually employs a weight stack, which is considerably less expensive to manufacture and to transport.

It is a further object of the present invention to provide exercise apparatus of this type for which the resistance applied to the cable or cables may be reduced to zero, or near zero.

It is a still further object of the present invention to provide exercise apparatus of this type with easy-to-use means for adding or subtracting small measures of resistance.

It is a still further object of the present invention to provide exercise apparatus of this type which operates in essentially the same way as known exercise equipment, and provides essentially the same response to a user, but which avoids the requirement that a weight stack be incorporated into the machine.

It is a still further object of the present invention to provide exercise apparatus of this type with friction reducing devices for reducing friction during movement of the weight stack.

These objects, as well as other objects which will become apparent from the discussion that follows, are achieved, in accordance with the present invention, by providing a source of resistance which includes at least two of (1) means for removably holding one or more weights, (2) means for removably attaching one or more springs, and/or (3) means for attaching one or more damping devices.

The means for coupling the handle or gripping device to the resistance source is preferably a cable, but any other mechanical means may also be used.

With such an improvement of the exercise equipment according to the invention, it is no longer necessary to incorporate a stack of weights in the machine to provide a constant resistance force, independent of the distance or speed with which the handle is pushed or pulled. According to the invention, the equipment is provided with means for holding one or more weights, for example weights of the type that are readily available at any fitness center or physical therapy facility. These weights may be metal disks which have a central hole to permit attachment to a cylindrical rod or the like, or they may be sandbags, concrete blocks, concrete filled cans or the like which are placed upon a suitable platform on the exercise equipment to provide a source of constant resistance to the user.

In addition or alternatively, means are provided for removably attaching one or more springs to provide a distance-dependent resistance force. Such a spring may be a tension spring, such as a coil spring, an elastic elongate member in the shape of a rod, tube, band, strap or flat strip, or a bendable rod. Such a spring may also be a compression spring which may be in the form of a coil spring or a bendable rod.

In addition or alternatively, means may be provided for attaching at least one damping device, such as a hydraulic or pneumatic damper or an electromagnetic resistance device, to provide a speed-dependent resistance force to the cable(s).

According to another aspect of the invention, the weight stack of the exercise apparatus is retained in the resistance source; however, a plate-like "retaining member" is disposed above the weight stack and coupled to the distal end of the cable so as to move vertically upward when lifted by the cable. This retaining member includes one or more hooks for attaching an upper end of a tension spring, a rod for retaining an additional, separate weight and a device for selectively coupling itself to the weight stack. In this way, a user can customize the resistance source to include tension springs, separate, selected weights and/or one or more weights in the weight stack.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
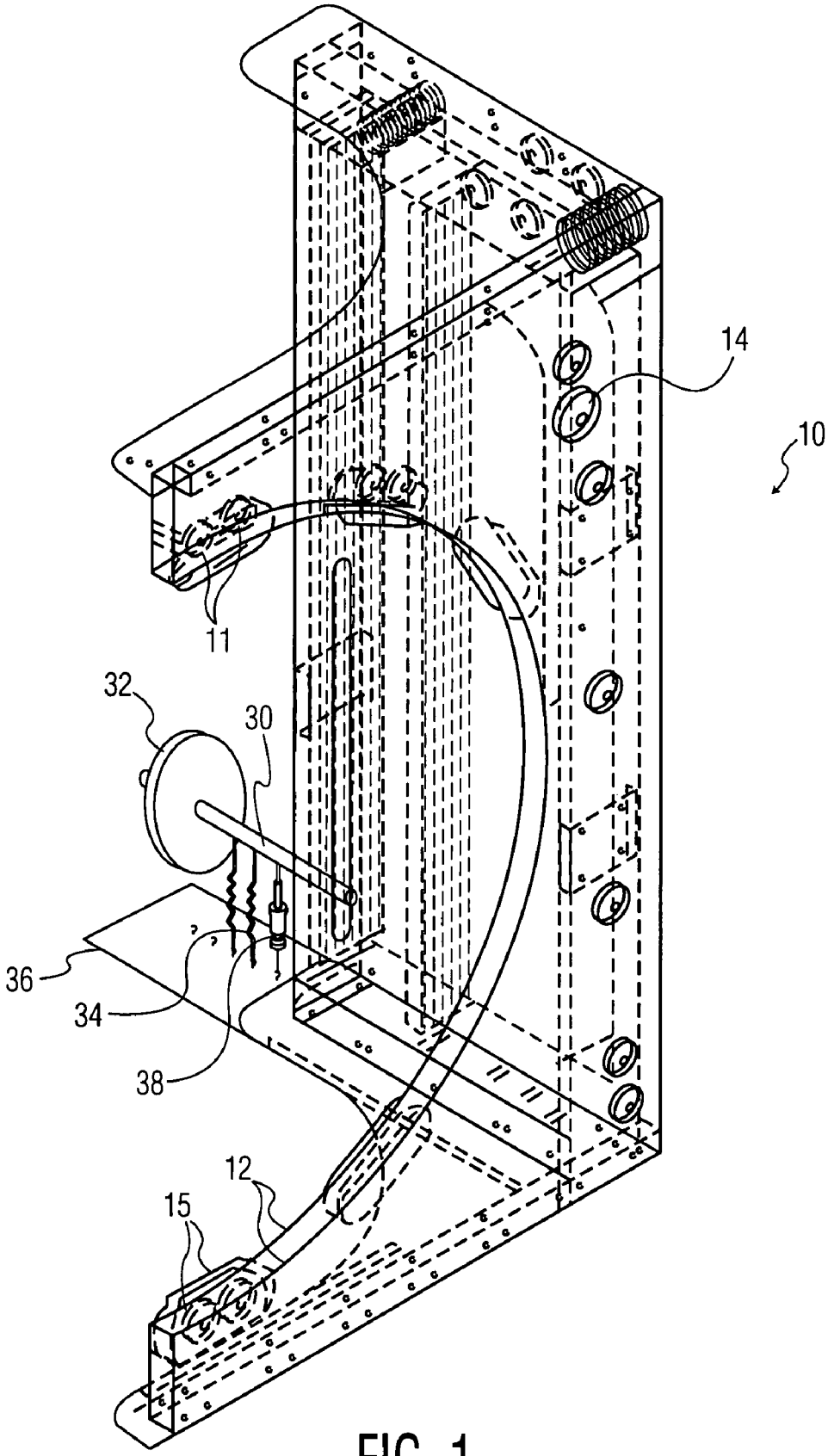
FIG. 1 is an isometric, perspective front view of a first preferred embodiment of exercise apparatus which incorporates the present invention.
Figure 2:
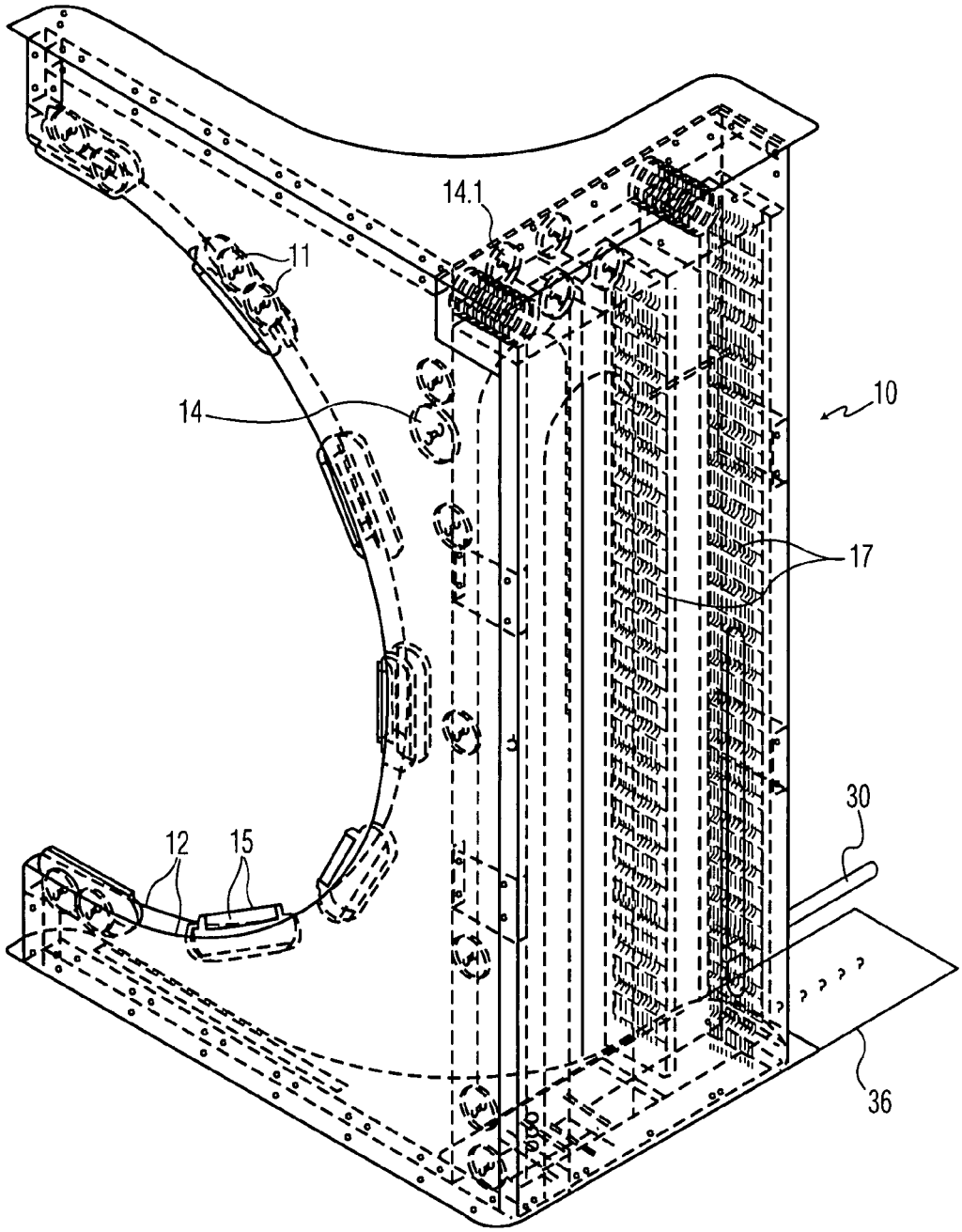
FIG. 2 is a rear perspective view of the apparatus of FIG. 1.

The preferred embodiments of the present invention will now be described with reference to FIGS. 1-28 of the drawings. Identical elements in the various figures are designated with the same reference numerals.

Figure 7:
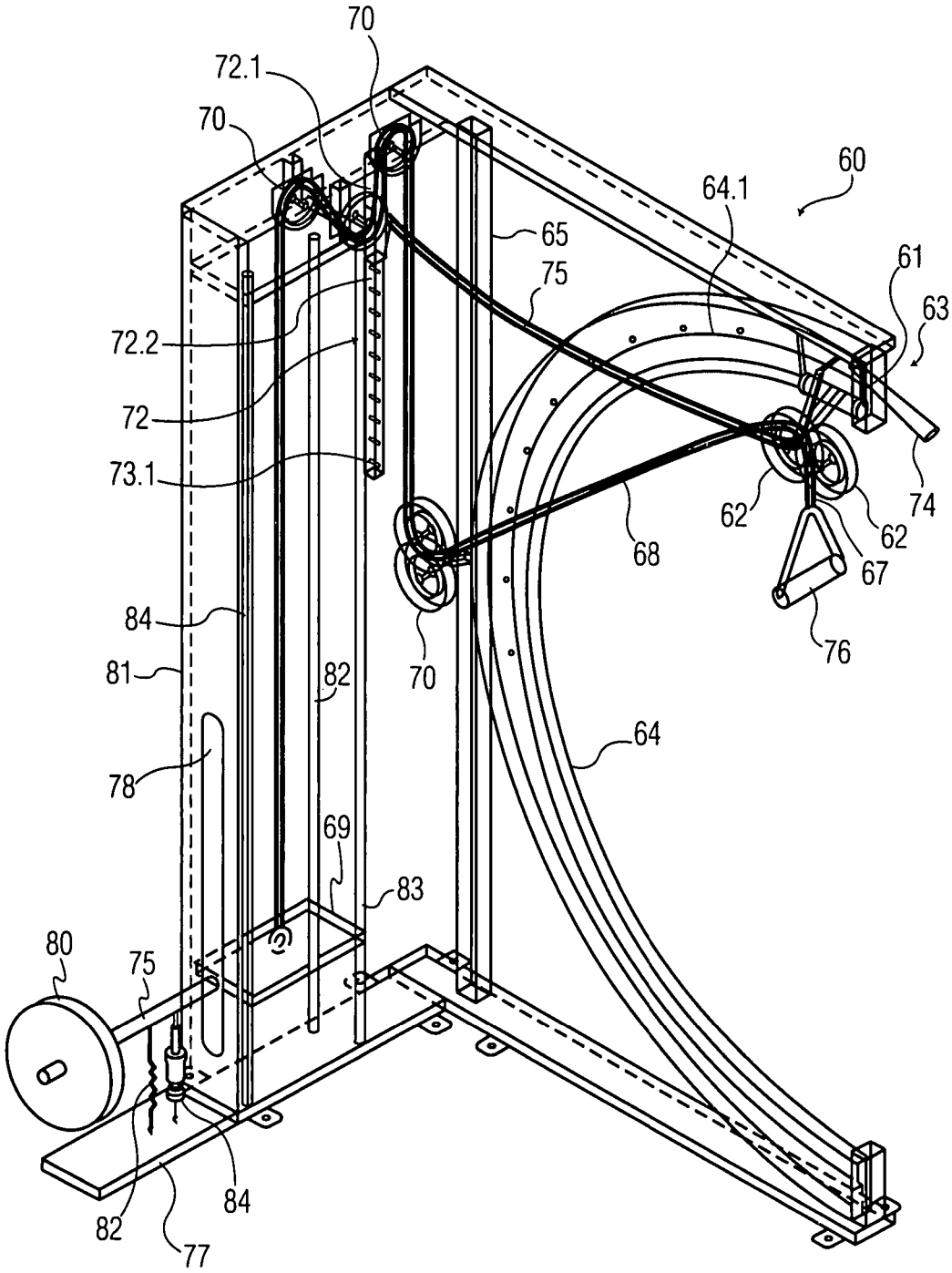
FIG. 7 is an isometric, perspective front view of a second embodiment of exercise apparatus which incorporates the present invention.
Figure 8:
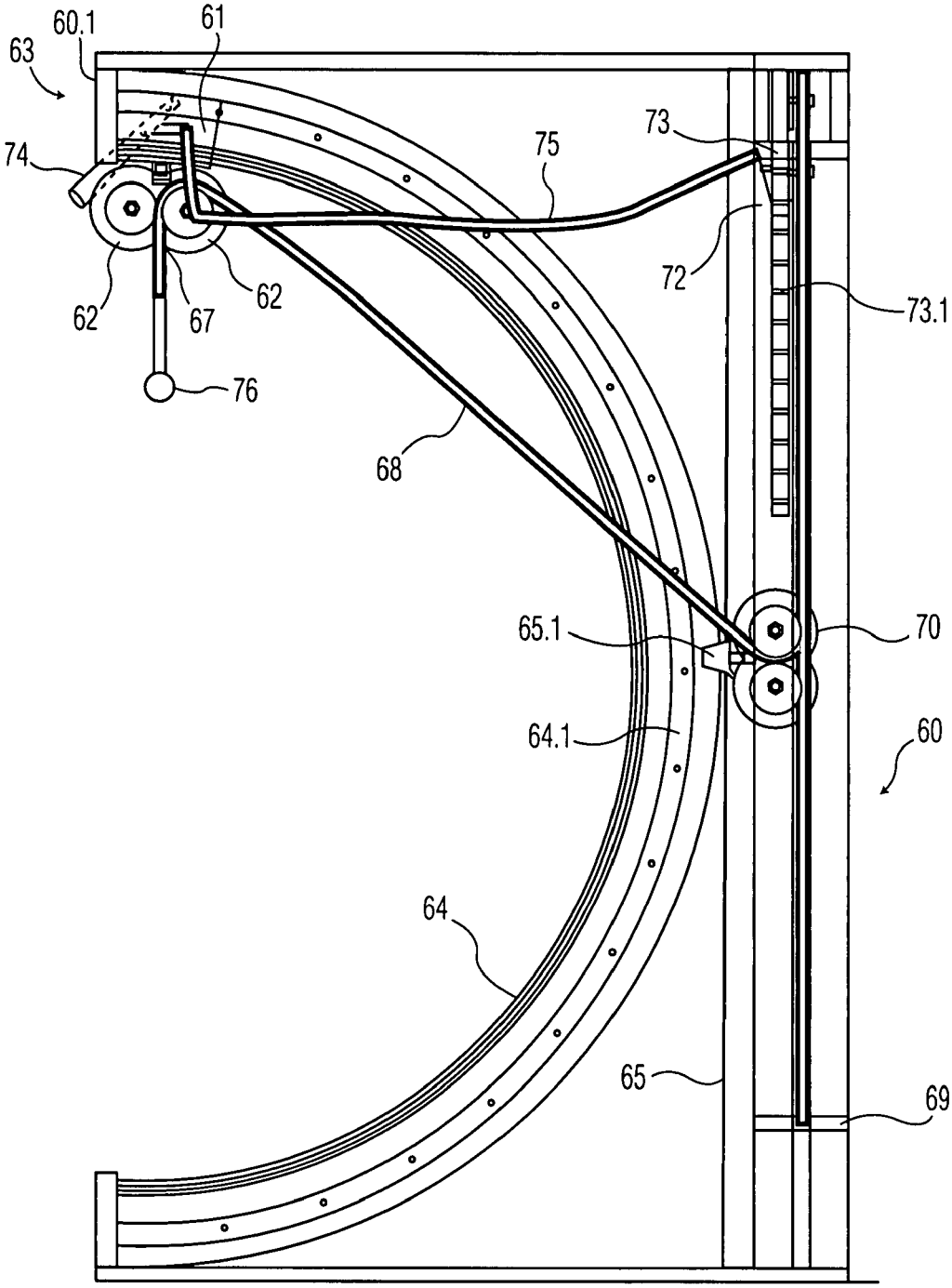
FIG. 8 is a cutaway side view of the apparatus of FIG. 7.
Figure 9:
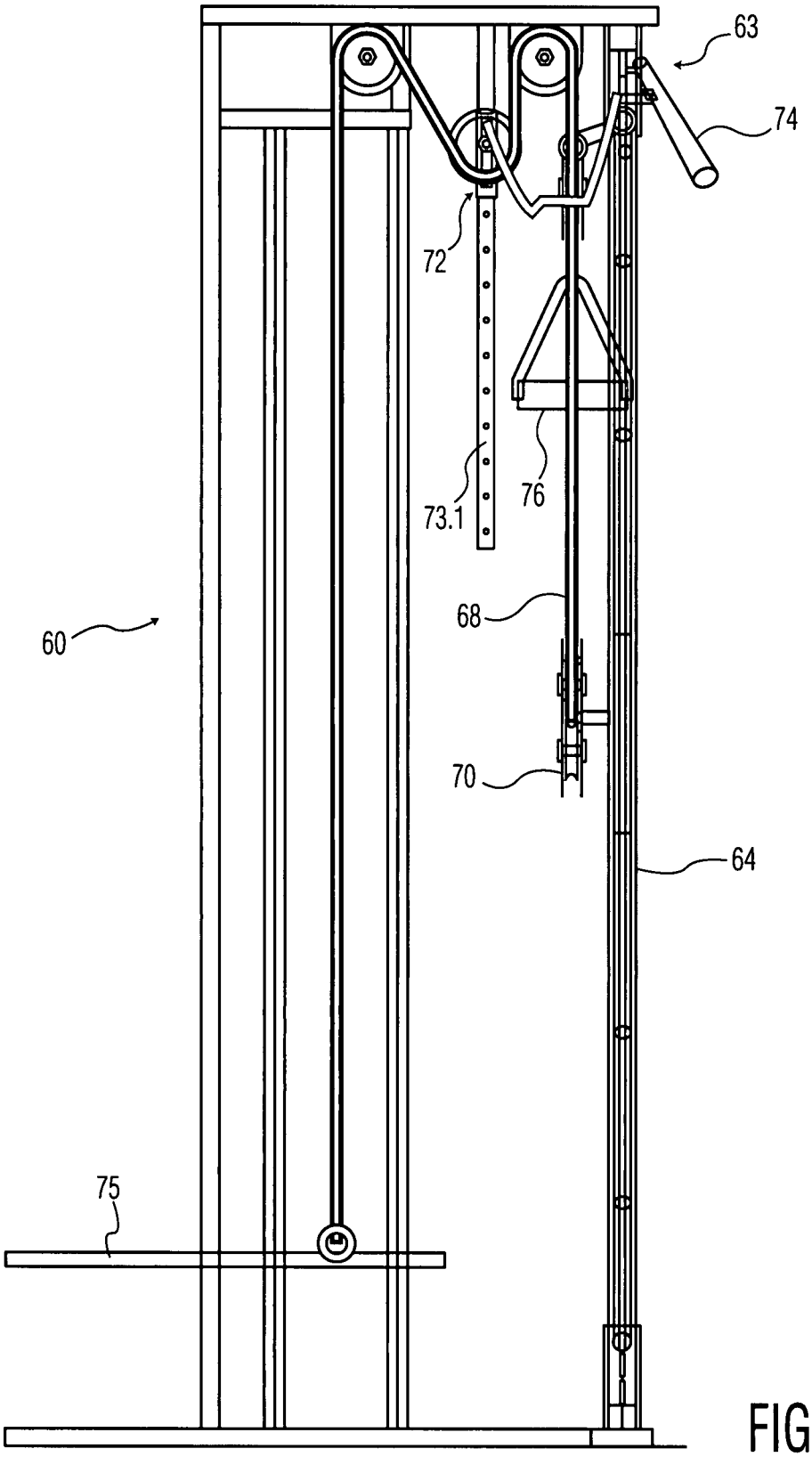
FIG. 9 is a cutaway rear view of the apparatus of FIG. 7.

FIGS. 1-6 illustrate a first preferred embodiment and FIGS. 7-9 illustrate a second preferred embodiment of the exercise equipment to which the present invention relates. Both embodiments are based on exercise equipment which is fully disclosed in the aforementioned U.S. Pat. No. 6,705,976. The present invention is applicable, but is not exclusively limited to, this type of exercise equipment.

Figure 3:
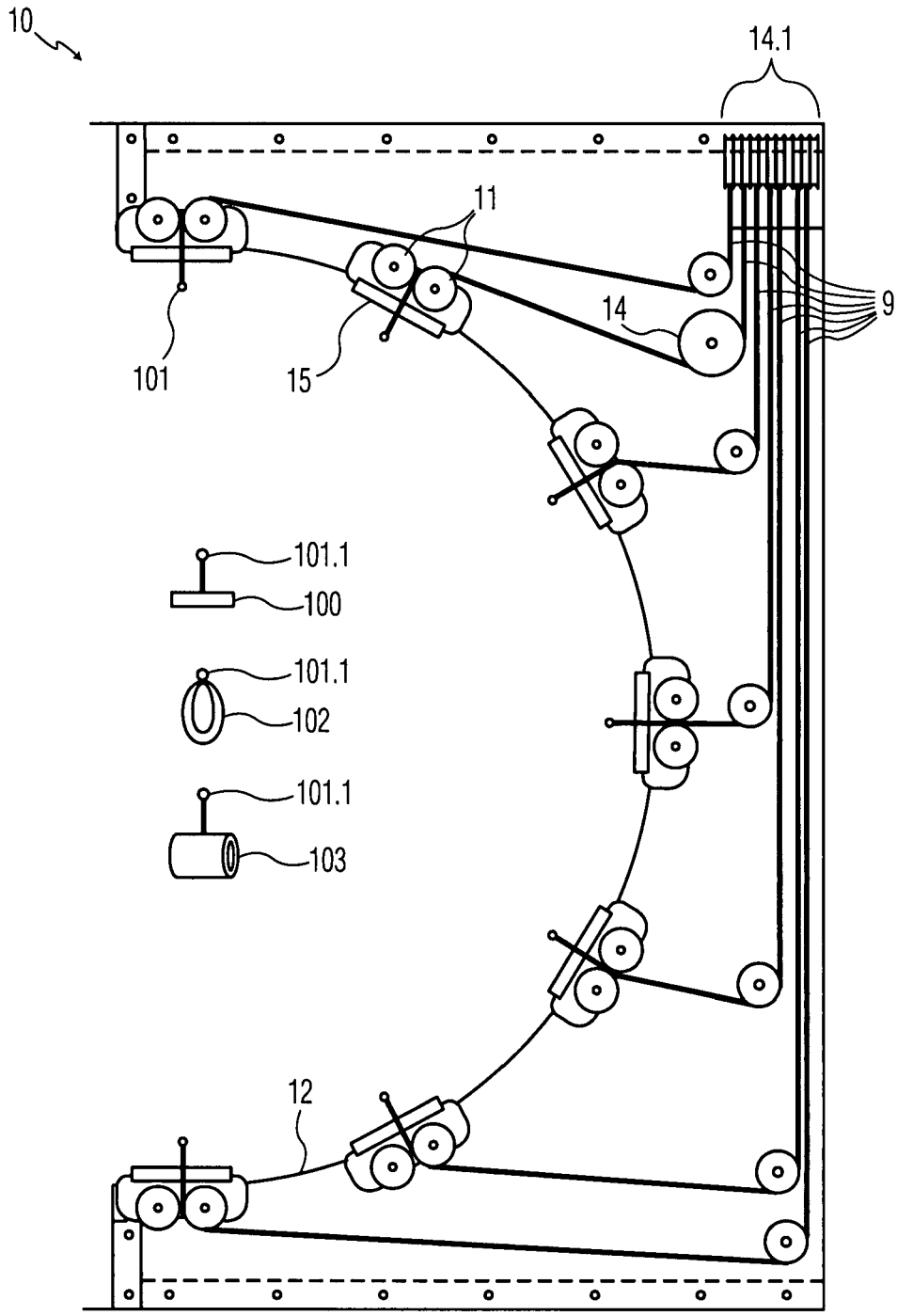
FIG. 3 is a cutaway side view of the apparatus of FIG. 1.

The first embodiment, shown in FIGS. 1-6, comprises exercise equipment 10 which incorporates a housing having a structural surface defining a concave arcuate contour. Disposed around this arcuate contour are seven pairs of pulleys, one pair of which is identified as 11. These pulleys are placed in an arcuate slot formed by two side frames 12. Each pair is spaced 30° away from its two neighbors, as is best seen in FIG. 3. A greater or smaller number of pairs of pulleys may be used.

Each pair of pulleys 11 defines, between them, a cable exit point positioned along the arcuate contour. Just outside each cable exit point is a pair of rollers 15 which retain the cable between them as it leaves the exit point so that it will not become dislodged from between the respective pair of pulleys 11.

As shown in FIG. 3, a separate cable 9 is passed through each one of the pairs of pulleys 11 to a proximal end 101. The proximal end of each cable 9, outside the rollers 15, is attached to a gripping device that enables a user to pull the cable away from the respective exit point. Examples of such devices are a bar 100, a loop handle 102 and a cuff 103, all of which have a fastener 101.1 that enables them to be attached to the proximal end 101 of each cable 9.

Figure 4:
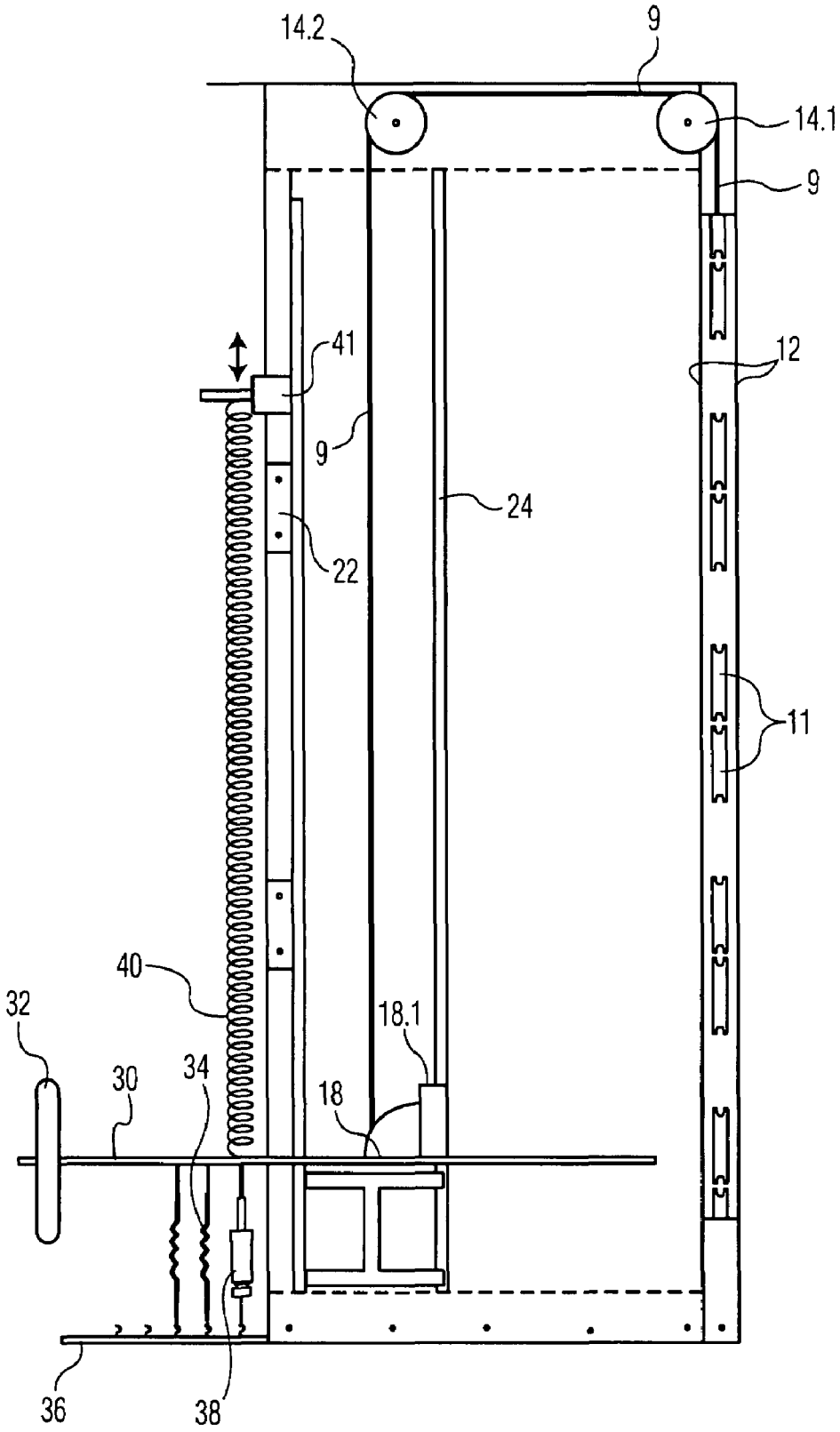
FIG. 4 is a cutaway rear view of the apparatus of FIG. 1.

The cables extend from their proximal ends 101 to a distal end which is coupled to a common source of resistance such that, when the proximal end of each cable is pulled by a user, the source of resistance exerts a counter force on the cable. Starting from the proximal end, each cable extends through one of the pairs of pulleys 11 and then to a direction changing pulley 14. From there, the cables are passed upward and over a parallel set of direction changing pulleys 14.1. Then, as is best seen in FIG. 4, the cables 9 pass horizontally to a further parallel set of direction changing pulleys 14.2 and finally downward to a mechanism, best seen in FIG. 5, which provides a common source of resistance and includes means for retaining each cable in a retracted position, when it is not being pulled by a user, even when one or more other cables are pulled by a user.

Figure 5:
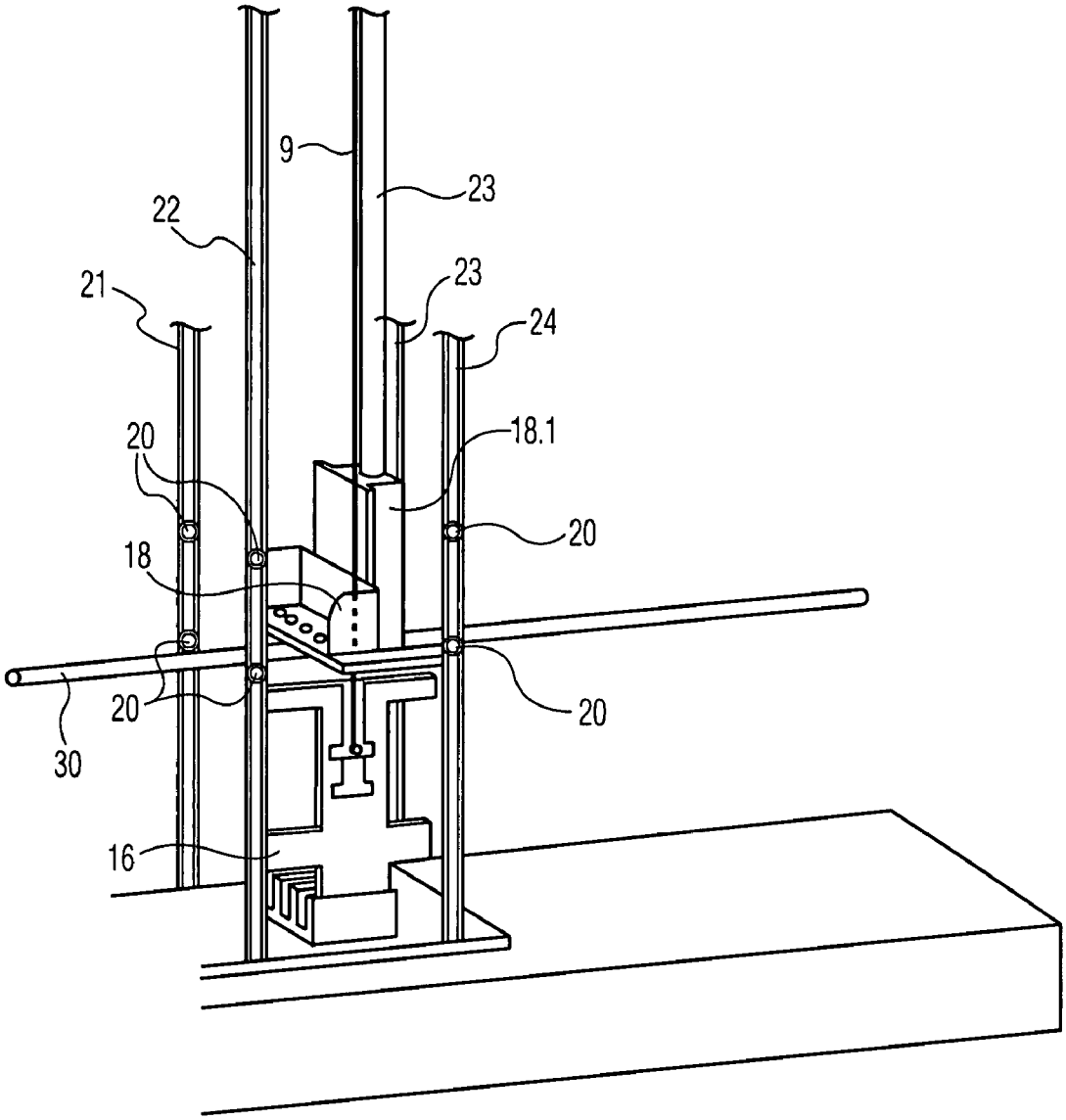
FIG. 5 is a detailed view showing a portion of the apparatus of FIG. 1.
Figure 6:
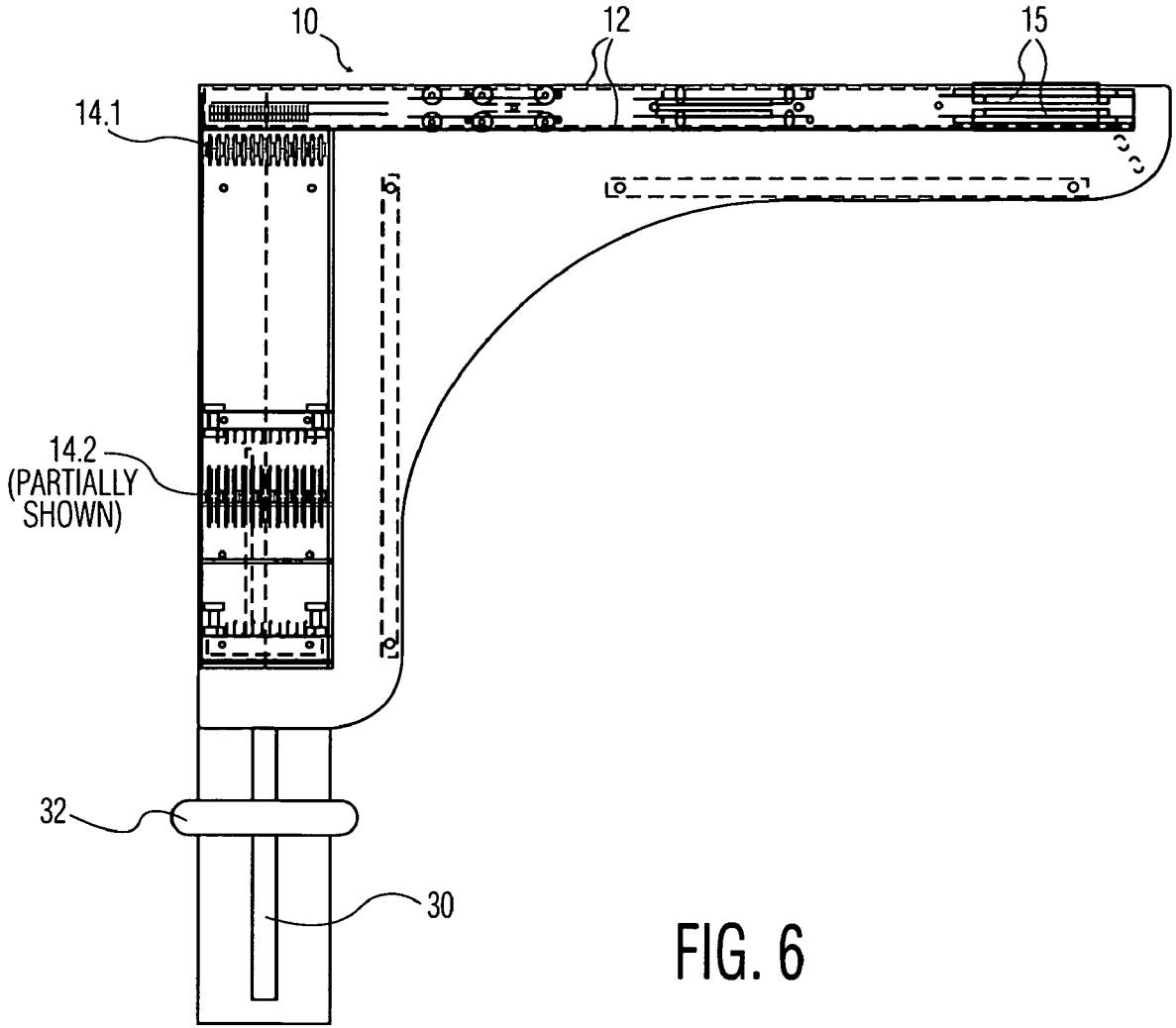
FIG. 6 is a top view of the apparatus of FIG. 1.

As may be seen in FIG. 5, the distal end of each cable 9 is ultimately attached to a counterweight 16 which travels vertically through a slot mounted in a housing, with the slots and counterweights 16 positioned side by side at the ends of their respective cables 9 (one counterweight 16 for each cable 9 threaded through the system). Immediately above the set of counterweights is a horizontal plate assembly 18 with seven holes therein, each hole being aligned with one of the downwardly descending cables 9 to permit this cable to pass through it for attachment to its respective counterweight 16. When a user pulls on the proximal end of a cable 9, the counterweight 16, attached to its distal end, is lifted thereby contacting and lifting the horizontal plate assembly 18.

The horizontal plate assembly 18 is constrained to move vertically. For this purpose, the plate assembly 18 is connected to four rollers 20 that slide within four vertical tracks 21, 22, 23 and 24. As a consequence, movement of one or more of the cables 9 will vertically lift the plate assembly 18. During such cable movement, the remaining cables will be retained in their normal, retracted position by their respective counterweights 16.

As mentioned previously, the exercise equipment 10 is provided with a common source of resistance. It is this source of resistance for which the present invention differs from the mechanism disclosed in the U.S. Pat. No. 6,705,976.

As best seen in FIG. 5, the source of resistance for the exercise equipment 10 comprises a "force transfer" means, such as the horizontal plate assembly 18 that is constrained by the sliding rollers 12 to move within the four vertical tracks 21-24, which transfers the force from the source of resistance to the cable 9 and, ultimately, the user handle 102.

It will be understood that any suitable arrangement may be used to constrain the movement of the force transfer means. For example, the force transfer means may be constrained to move substantially vertically, up and down, on Teflon bearings that slide on vertical guide rods. Alternatively, the force transfer means may move in any desired direction if only springs and/or dampers are used as a source of resistance.

When weights are used, the exercise equipment is provided with means for removably holding a selected number of these weights during upward movement of the force transfer means 18. This holding means may include a device, such as the horizontal, cylindrical rod 30, upon which a number of weights 32 may be mounted. The weights 32 are preferably of the type normally found at a fitness center or physical therapy facility so that, as a consequence, the machine need not be provided with such weights when manufactured and delivered.

Alternatively, or in addition, the means for exerting a resistance on the force transfer means 18 when it moves may include a device for removably attaching one or more springs, such as tension springs 34 shown in FIGS. 1 and 4 and/or compression springs 40 shown in FIG. 4. The tension springs may be attached between the rod 30 and a member 36 which extends outward from the bottom portion of the frame of the exercise equipment. Alternatively, or in addition to, such tension spring(s), one or more compression springs 40 may be provided to exert the resistance force against the force transfer means. The downward force exerted by a compression spring 40 may be adjusted by adjusting the vertical position of block 41 which holds the top of the spring.

As in the case of the weights, the tension spring or springs 34 are made removable so that the amount of resistance may be easily adjusted by selecting springs of different tension and/or by attaching a desired number of springs.

The tension springs 34 may comprise one or more coil springs, elastic bands, straps, rods or tube, or the spring may be in the form of a bendable rod. Similarly, the compression 40 spring may be a coil spring which is retained by a rod through its center or within a surrounding tube or a bendable rod, as is well known in the field of exercise equipment.

Figure 10A:
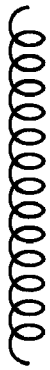
FIGS. 10*a*-10*d* are side views of various types of springs which may be used in the exercise apparatus of FIGS. 1-9.
Figure 10B:
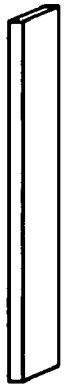
Figure 10C:
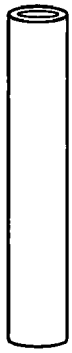
Figure 10D:
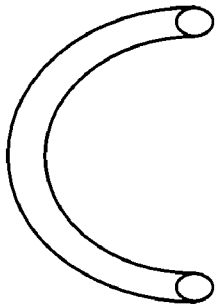

Various types of springs are illustrated in FIGS. 10*a*-10*d*. FIG. 10*a* illustrates a coil spring, FIG. 10*b* illustrates an elastic elongate band, FIG. 10*c* illustrates an elastic tube and FIG. 10*d* illustrates a bendable rod.

Alternatively, or in addition to the weights and/or springs which are removably attached to the exercise equipment, one or more dampers 38 may be connected between the force transfer means 18 or rod 30 and the frame of the exercise equipment, or member 76, as illustrated in FIGS. 1 and 4.

Each damper 38 may comprise a hydraulic damper, pneumatic damper or an electromagnetic resistance element. Such a damper operates in the manner of a "shock absorber" in a motor vehicle suspension system. The amount of resistance force that it exerts is dependent upon the relative speed of displacement between its two ends.

The present invention thus provides a simple and relatively inexpensive means for exerting a resistance force against the retraction of one or more cables 9 when pulled from their proximal ends 101. The present invention makes it possible to apply three types of resistance force, either separately or together:

(1) a constant resistance force W produced by a weight or weights 32;

(2) a distance-dependent force which results from spring(s) 34; and (3) a speed-dependent force which results from one or more dampers 38.

A second embodiment of the present invention is illustrated in FIGS. 7-9. In this case, the exercise equipment is provided with a single cable 68 having a proximal end 67 that passes through a pair of pulleys 62. The pulley pair 62 is mounted on a movable trolley system 63 that can be repositioned along a track 64 attached to the housing 61.

As in the case of the first embodiment, the proximal end of the cable 68 is attached to a gripping device or handle 76 so that it may be pulled by a user.

After passing through the pulley pair 62, the cable 68 is directed through a set of pulleys 70 after which it ultimately extends downward to a source of resistance 69.

Since the distance between the pulley pair 72 and the first pair of pulleys 70 will vary as the trolley 63 is repositioned along the track 64, a cable takeup mechanism, comprising a pulley 72.1 which is moveable along a moveable bar 73.1, is provided. As the trolley is moved, a lever 74 is rotated about a pivot connection to pull the end of a flexible sheath cable 75. When the lever 74 is moved, the cable takeup mechanism 72 travels in a substantially vertical direction up or down in direct proportion to the distance the moveable trolley 63 is moved along the arced curve. Once the new position is found for the moveable trolley 63 the lever 74 is moved back causing a pin 73 to slide into a corresponding hole along the vertical rod 73.1 holding the pulley 72.1 in place.

The source of resistance in this second embodiment is considerably simpler than that of the first embodiment described above. In this embodiment the distal end of the cable 75 is attached to a plate 69 which is constrained to move vertically by vertical tracks 81, 82, 83, 84 arranged in each corner. This plate 69 serves as the force transfer device in this embodiment.

Extending outward from this plate 69 is a rod 75 of suitable size and diameter to hold one or more disk shaped weights 80. As in the case of the first embodiment, one or more tension springs 82 or dampers 84 may be connected between the rod 75 and a frame member 77 which protrudes outward from the bottom of the exercise equipment.

When in use, a pull on the gripping handle 76 results in raising the force transfer device 69 and, in turn, the resistance exerting device 75 which protrudes through a slot 78 in the housing. The resistance provided at the distal end of the cable 68 is easily adjusted by adding or subtracting weights 80, springs 82 or dampers 84 from the rod 75.

Alternatively, instead of providing a separate rod 75 which protrudes through the slot 78 in the housing, the means for removably holding one or more weights, for removably attaching one or more springs and/or for removably attaching one or more damping devices may be incorporated entirely within the housing. For example, weights such as sandbags, cement blocks, cement-filled cans or the like may be placed directly upon the plate 69, and the springs 82 and dampers 84 may be attached, by means of hooks, eyes or the like, between the plate 69 and the base of the housing directly beneath it.

With the exception of the fact that the second embodiment operates with only a single cable, the force transfer device and the resistance exerting device in the first and second embodiments are essentially the same.

FIGS. 11-14 illustrate several additional preferred embodiments of exercise equipment to which the present invention relates. Various elements shown in these figures, to the extent that they are similar or identical to corresponding elements in the embodiment of FIGS. 1-6, are designated with the same reference numerals.

Figure 11:
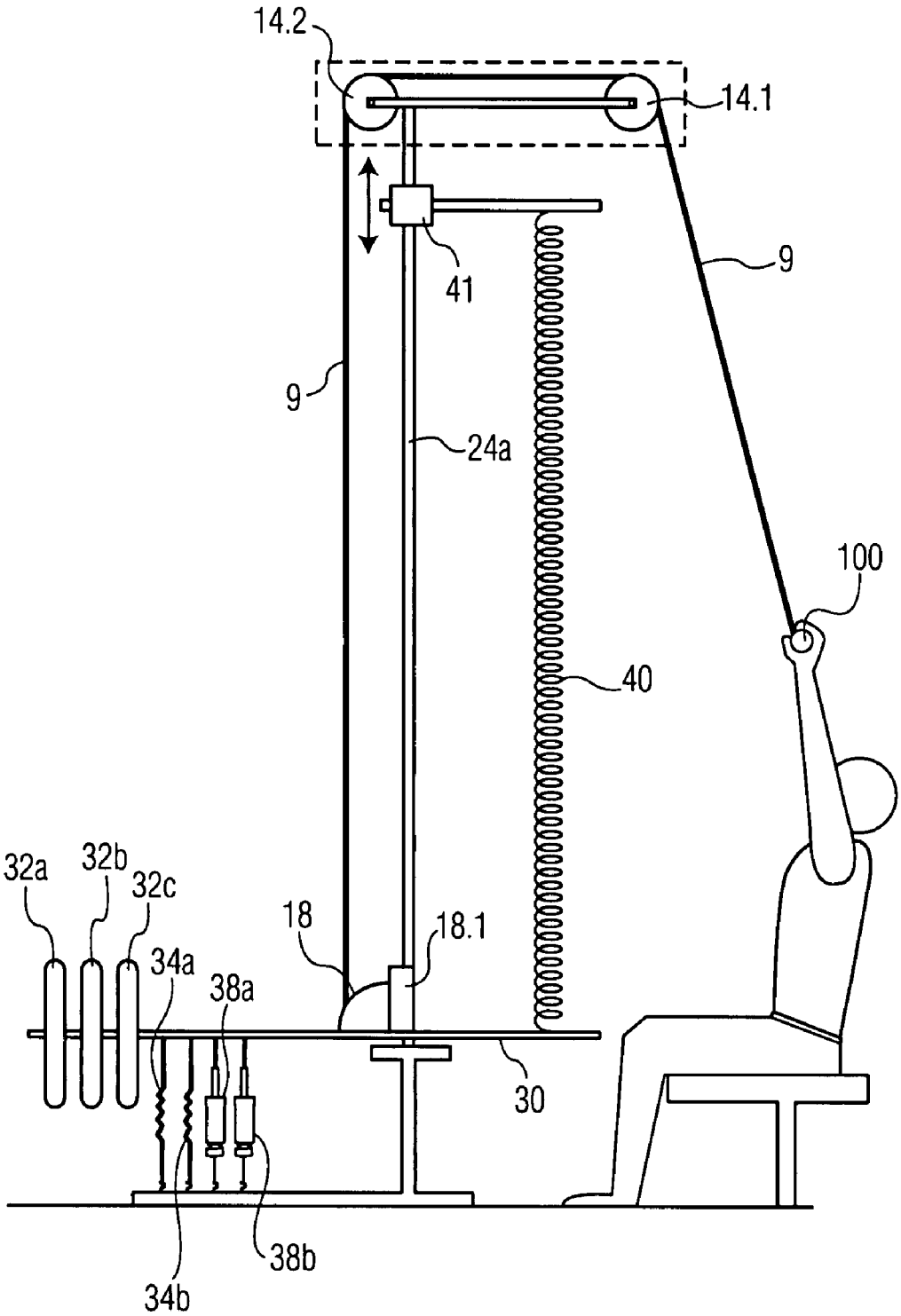
FIG. 11 is a side view, similar to FIG. 4, showing a further embodiment of exercise apparatus incorporating the present invention.

FIG. 11 shows exercise apparatus in which the user grabs a handle 100 attached to a proximal end of a cable 9, and pulls downward. The cable passes over pulleys 14.1 and 14.2 to a distal end which is attached to an assembly 18 having a bearing 18.1 which surrounds and slides over one or more vertical poles 24. The precise arrangement, which uses two parallel poles 24*a* and 24*b*, is illustrated in greater detail in side and rear views, respectively, in FIGS. 15*a* and 15*b*.

As the user pulls downward on the cable 9, the assembly 18 raises a horizontal rod or bar 30. To this bar may be attached one or more of the following resistance devices:

One or more weights 32*a*, 32*b* and 32*c;*

One or more tension springs 34*a* and 34*b;*

One or more dampers 38*a* and 38*b*; and

One or more compression springs 40.

The assembly 18 thus serves as a "force transfer device" coupled to the distal end of cable 9 whereas the bar 30 serves as a means for exerting a counter-force against the force transfer device when the force transfer device is raised upward.

Figure 12:
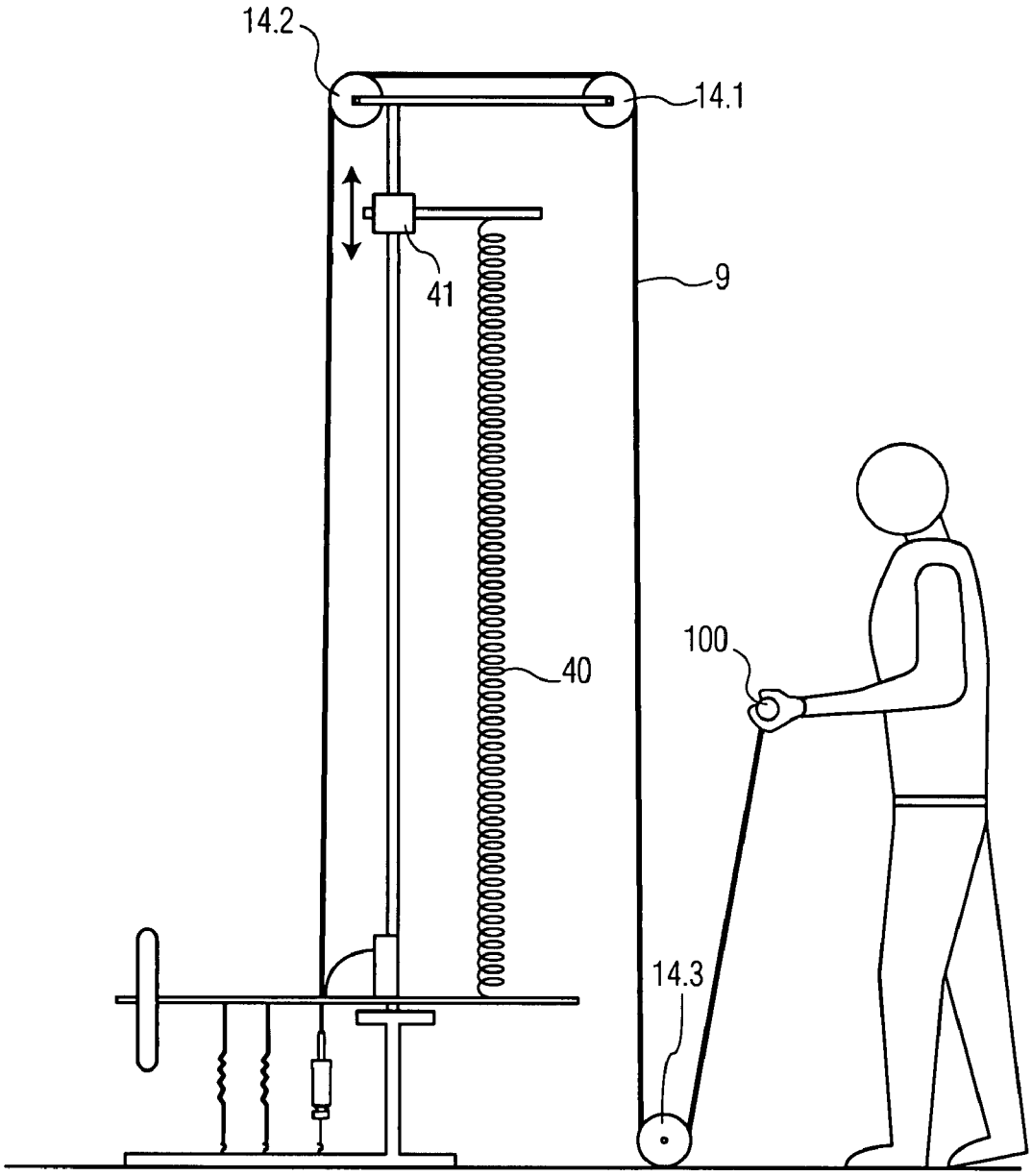
FIG. 12 is a side view showing a still further embodiment of exercise apparatus, similar to that of FIG. 11, incorporating the present invention.

FIG. 12 shows an alternative embodiment wherein the cable 9 extends downward to a pulley 14.3 at the base of the equipment. In use, the handle 100 attached to the proximal end of the cable must be pulled upward, rather than downward as in the case of the exercise equipment of FIG. 11. Otherwise, this exercise equipment is identical to that of FIG. 11.

Figure 13:
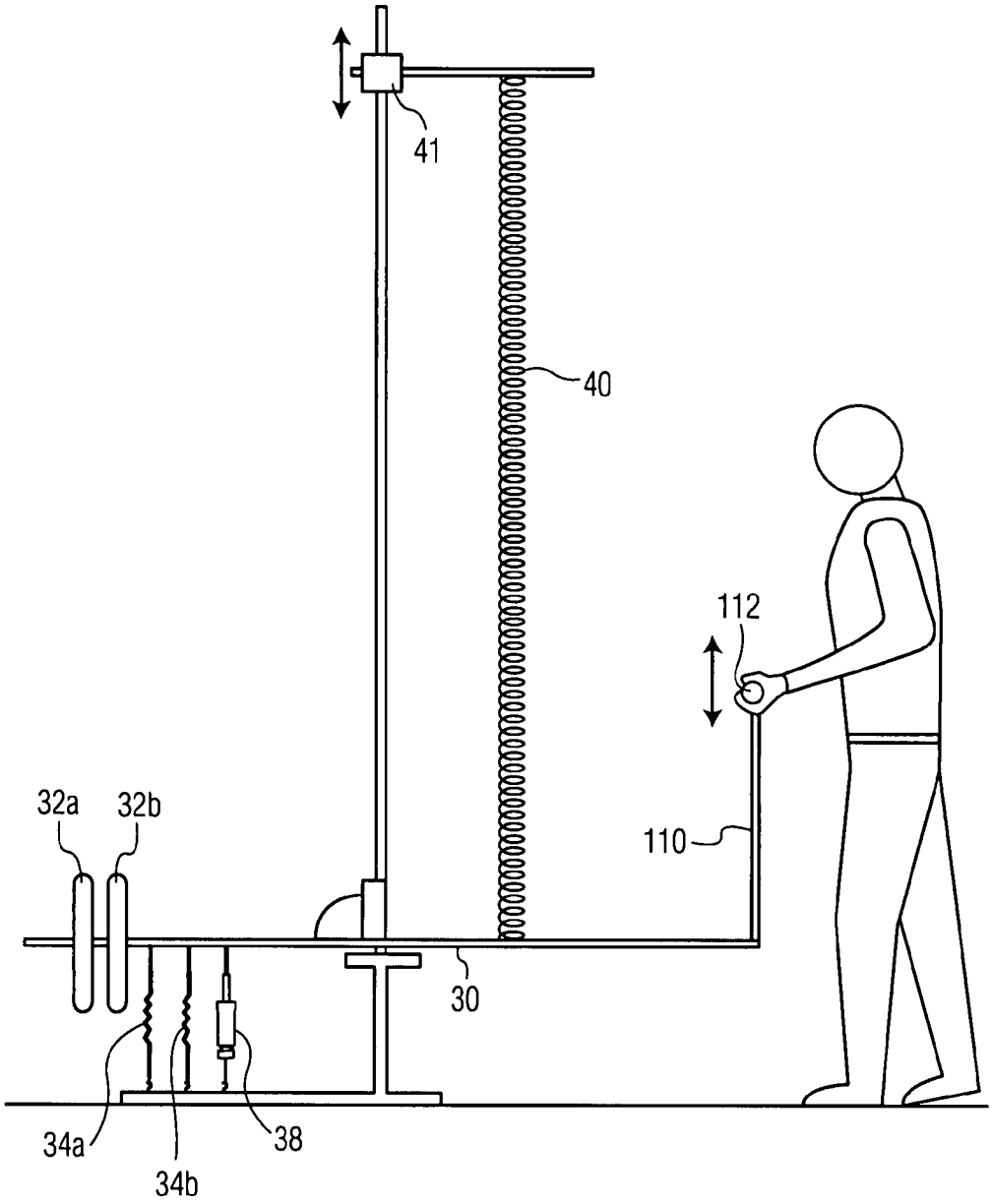
FIG. 13 is a side view showing a still further embodiment of exercise apparatus incorporating the present invention.

FIG. 13 illustrates exercise apparatus which is also very similar to that of FIGS. 11 and 12, but which avoids the use of the cable 9. In this embodiment, the rod or bar 30 is rigidly attached to a bar 110 which extends upward to a handle 112 at substantially waist height. The length of the bar 110 may be adjustable to adjust the height of the handle 112.

Figure 14:
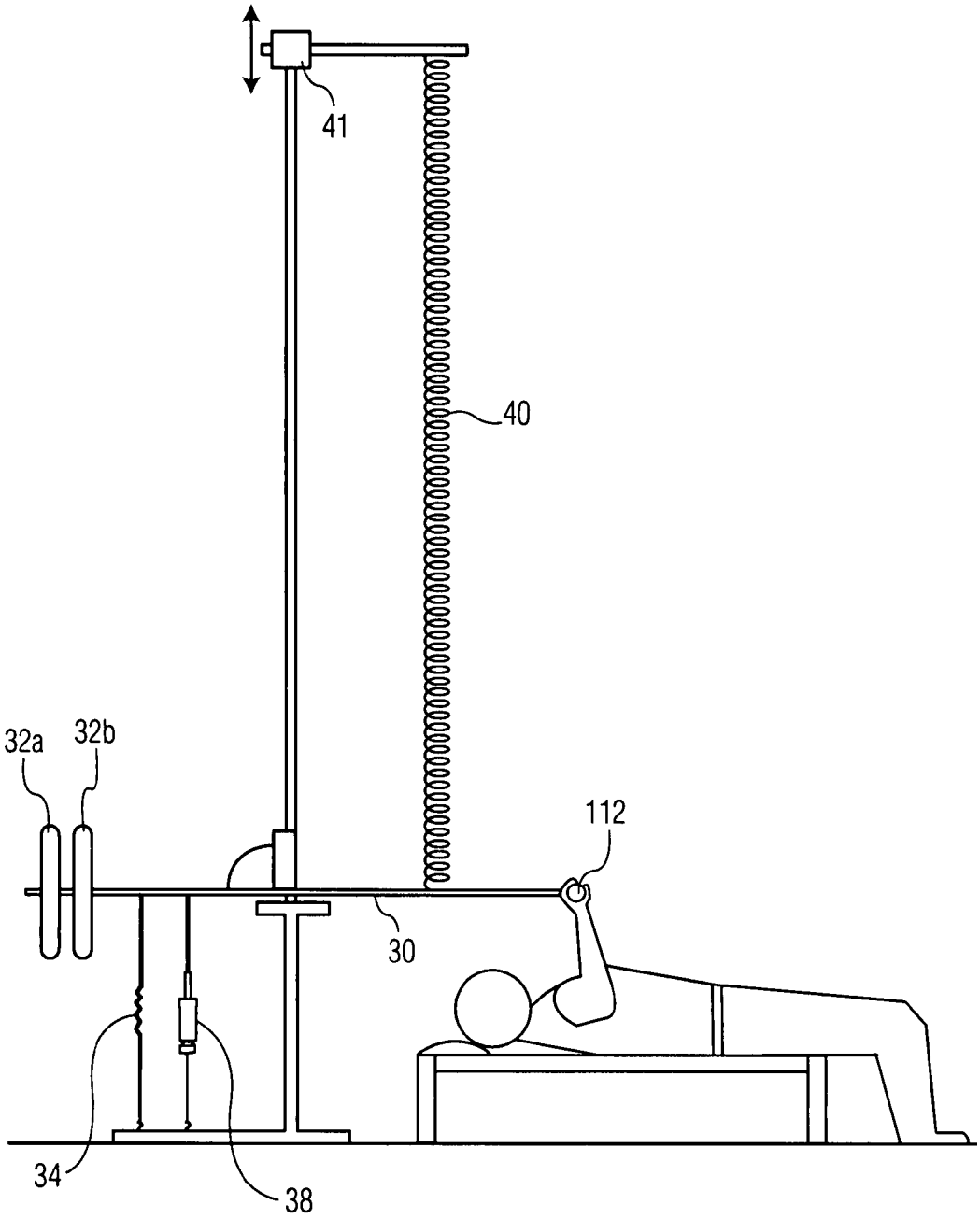
FIG. 14 is a side view showing a still further embodiment of exercise apparatus, similar to that of FIG. 13, incorporating the present invention.

In a still further embodiment shown in FIG. 14, the handle 112 is attached directly to the end of the rod or bar 30 so that the user may operate the exercise equipment while in the prone position.

Figures 15A, 15B, 16A, 16B, 16C:
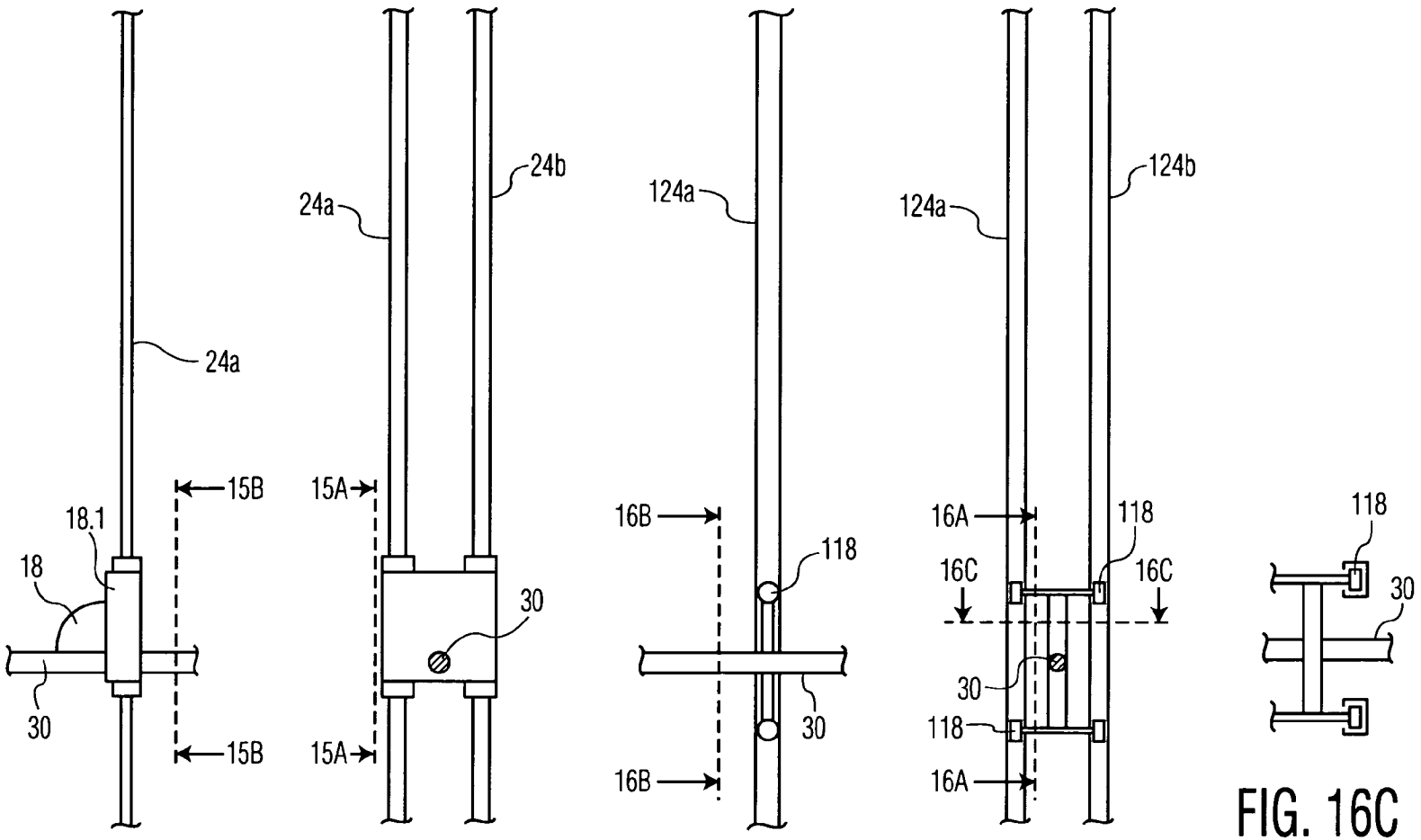
FIGS. 15*a* and 15*b* are side and rear views, respectively, showing a detail of the exercise apparatus of FIGS. 11-14.
FIGS. 16*a*, 16*b* and 16*c* are side, rear and top views, respectively, showing a detail of the exercise apparatus of FIGS. 11-14, in an alternative embodiment.

FIGS. 16*a* and 16*b* show an alternative embodiment of the force transfer device 18. In this embodiment, the bar 30 is fixed to a trolley mechanism 118 which is arranged in two parallel tracks 124*a* and 124*b*. These tracks, and the track followers, are of the type which movably retain garage doors.

It will be understood that various other mechanisms can be used so that movement of the force transfer means is substantially linear. Similarly, instead of providing a horizontal bar 30 for holding disk type weights, the means for removably holding the weights may be a horizontal platform, with or without a vertical bar extending upward from it.

Figure 17:
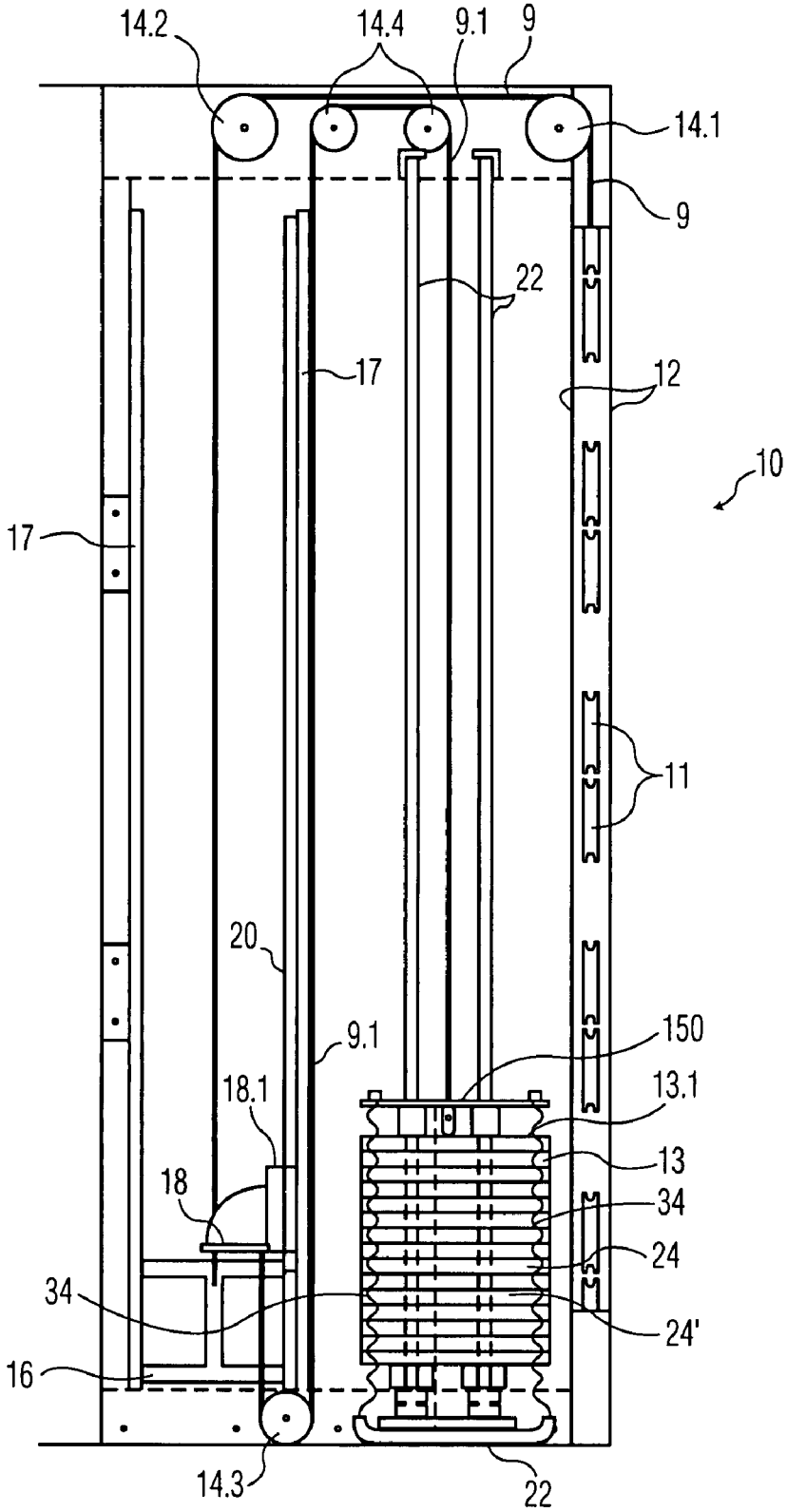
FIG. 17 is a side view, similar to that of FIG. 4, of still another embodiment of the exercise apparatus of the present invention.

FIG. 17 illustrates a resistance source for a cable actuated exercise machine of the type disclosed in the aforementioned U.S. Pat. No. 6,705,976 which has been incorporated herein by reference.

Figure 18:
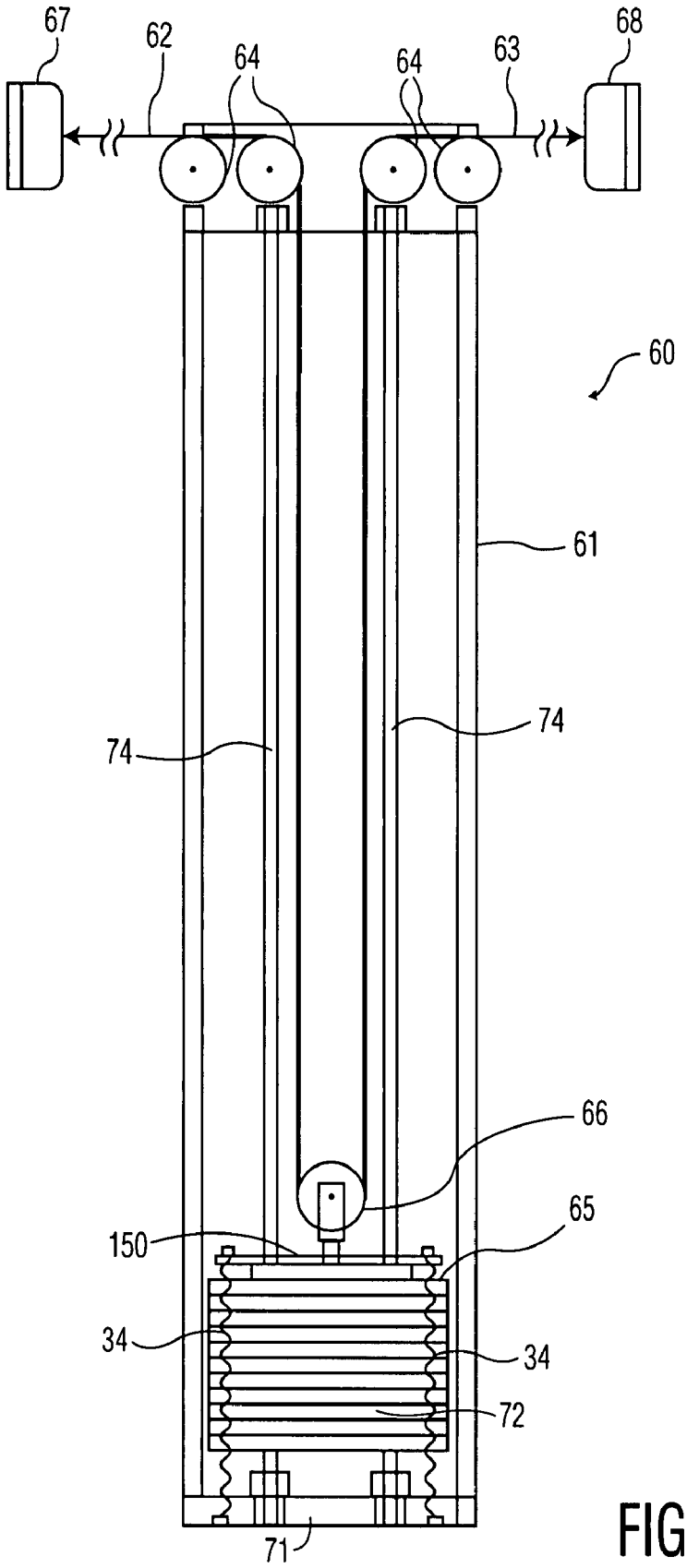
FIG. 18 is a side view, similar to that of FIGS. 4 and 17, of still another embodiment of the exercise apparatus according to the present invention.

FIG. 18 shows a resistance source, similar to that shown in FIG. 17, except that in the apparatus of FIG. 17 the distal end of the cable is coupled directly to a plate 150 at the top of a weight stack 24, whereas in the apparatus of FIG. 18 the distal end of the cable is wound around a pulley 66. In the latter arrangement, the pulley provides a 50% reduction in the force required to lift the weights in the weight stack.

In both the apparatus of FIG. 17 and FIG. 18, the resistance source not only includes a selected number of weights in the weight stack, but also can selectively include one or more tension springs 34. These tension springs or more specifically, elastic bands are attachable to hooks formed on the plate 150 at the top of the weight stack, and moveable upwardly therewith, and fixed hooks attached to the lowermost part of the housing.

Figure 23:
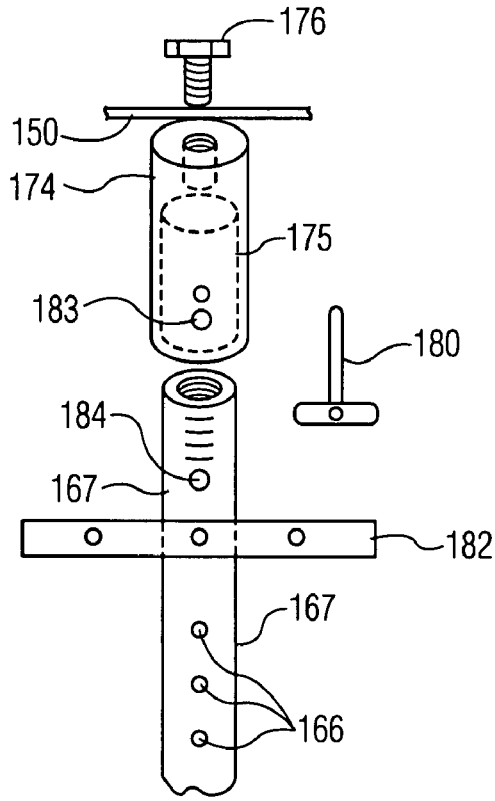
Figure 24:
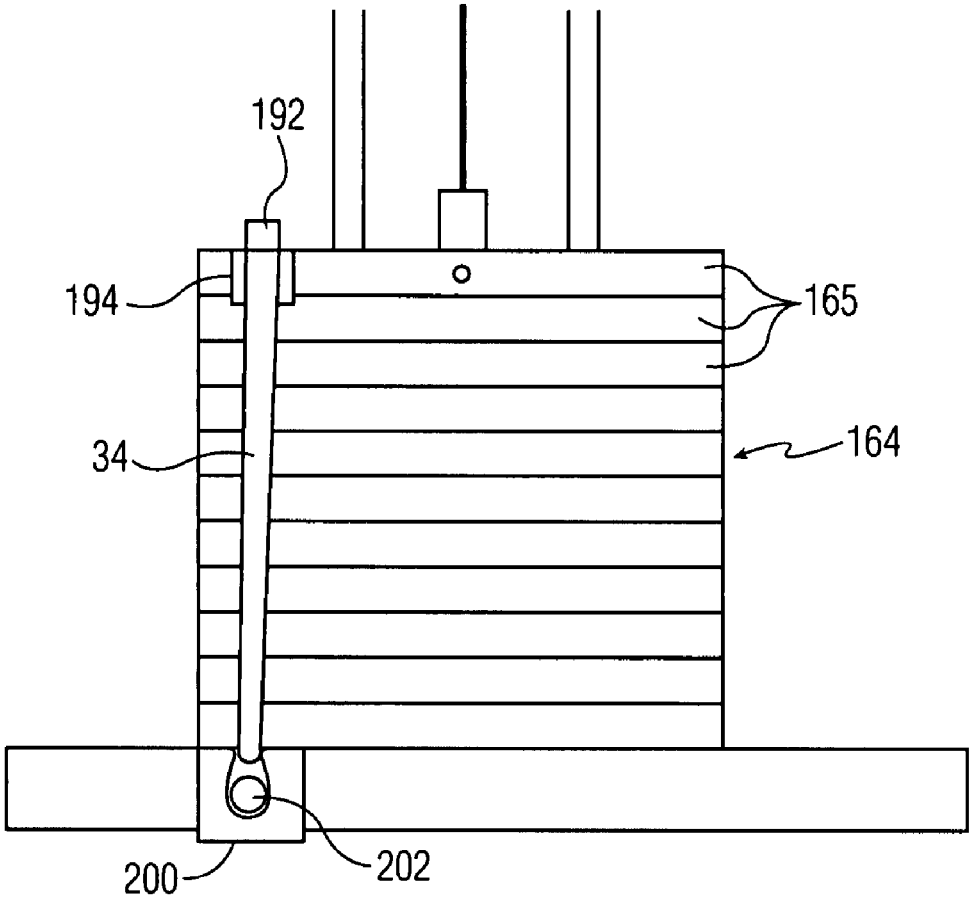
FIGS. 24, 25 and 26 are detailed views of a resistance source of the type used in the exercise apparatus of FIG. 17 in two side views and in top view, respectively.
Figure 25:
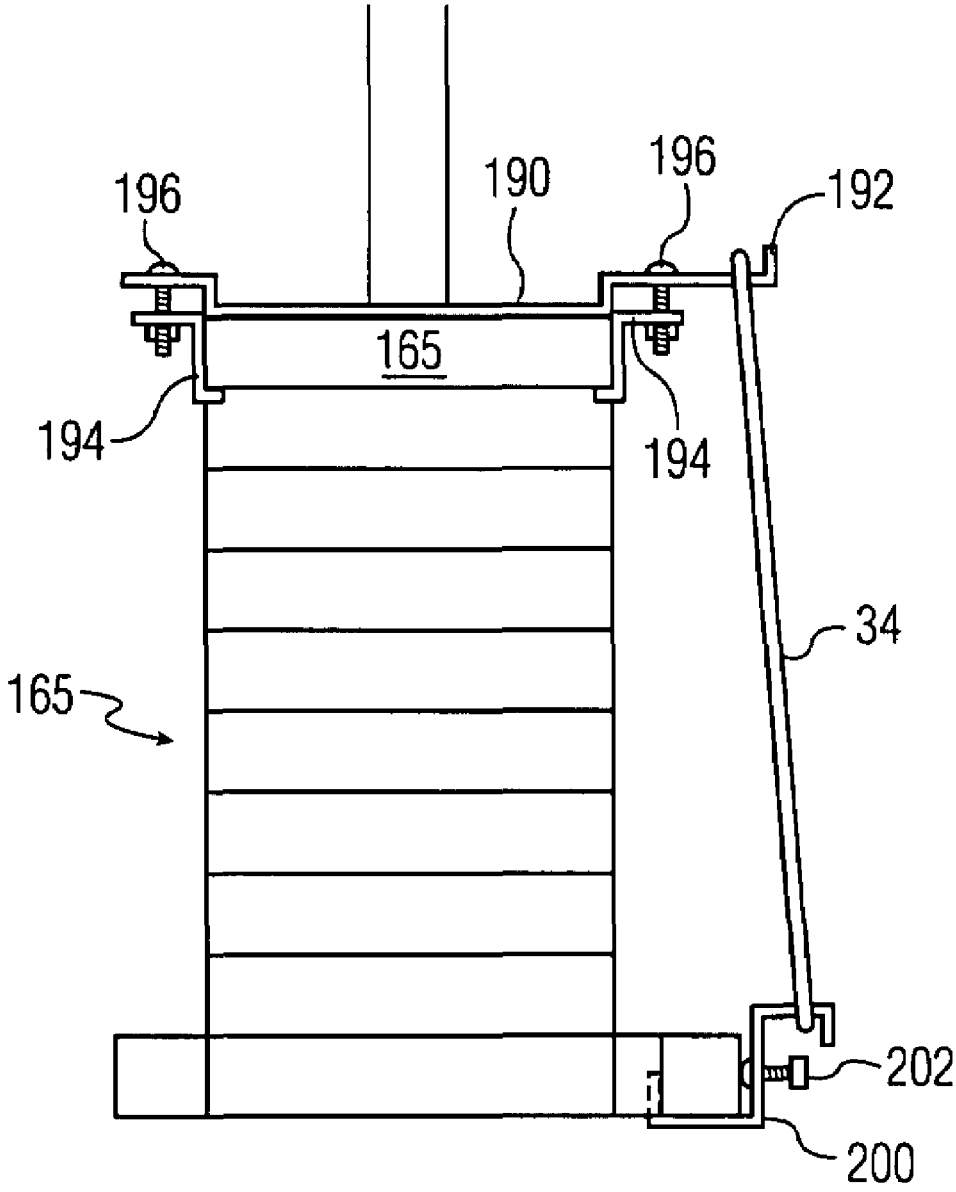
Figure 26:
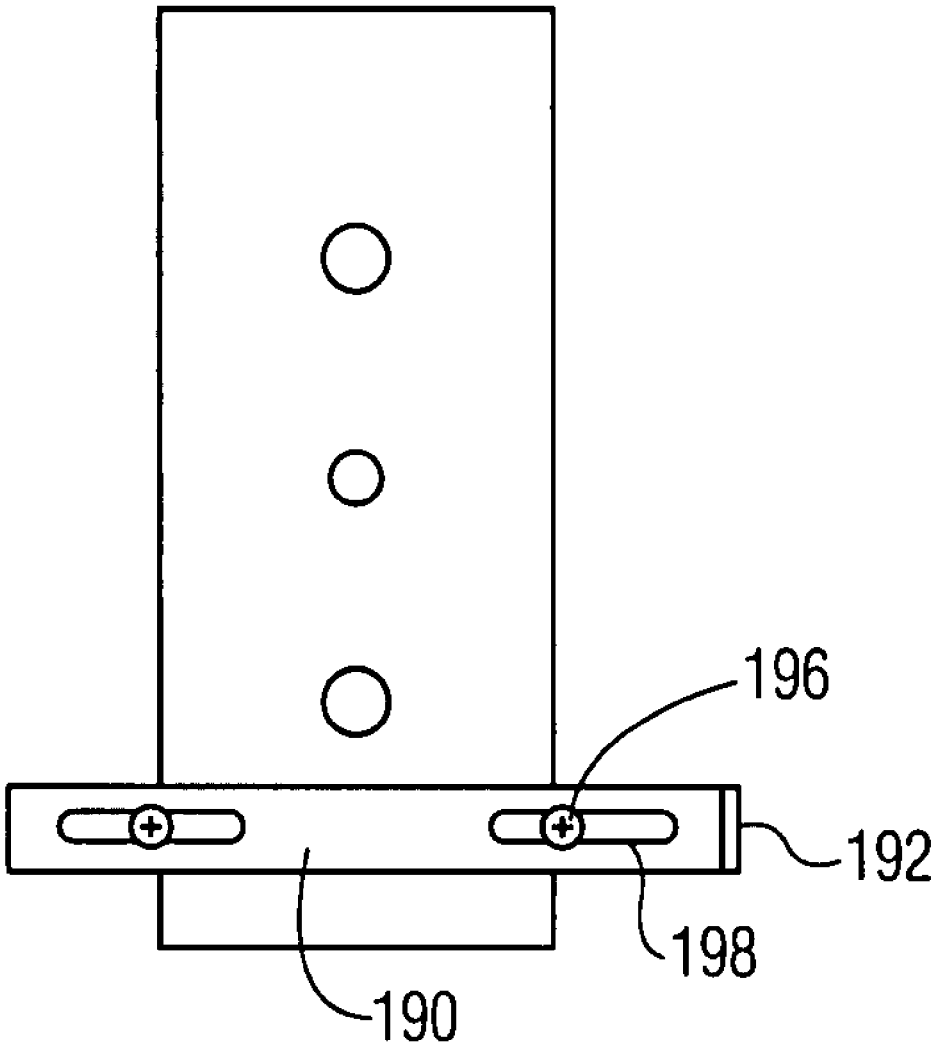

FIGS. 19-23 illustrate one type of arrangement for holding the tension springs 34 and FIGS. 24-26 show another device for this same purpose.

Figure 19C:
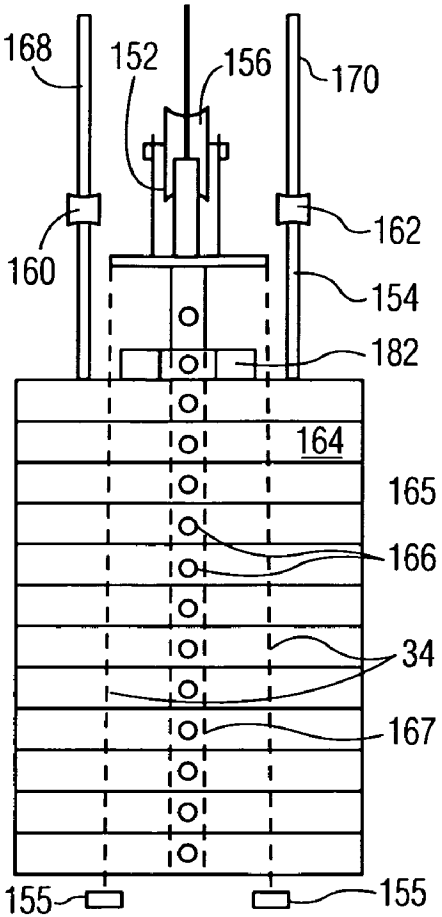
FIGS. 19*a*, 19*b* and 19*c* are detailed views of the top and two sides of a resistance source of the type used in the exercise apparatus of FIG. 18.
Figure 19B:
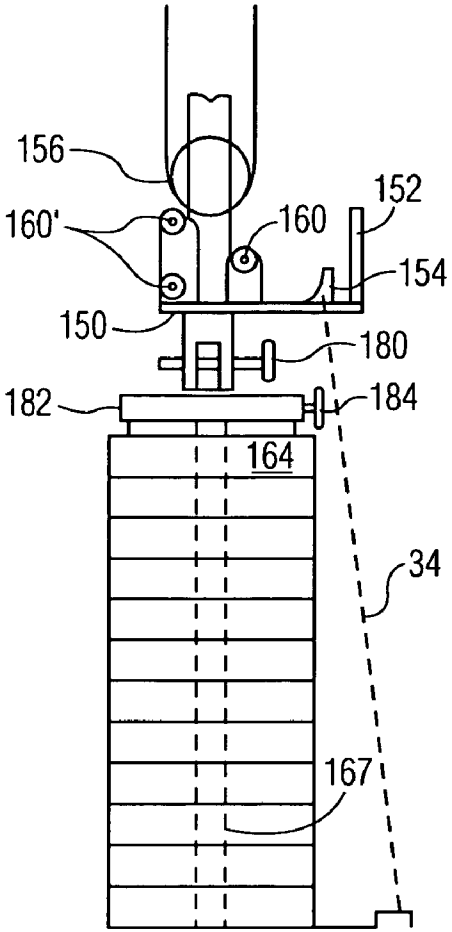
Figure 19A:
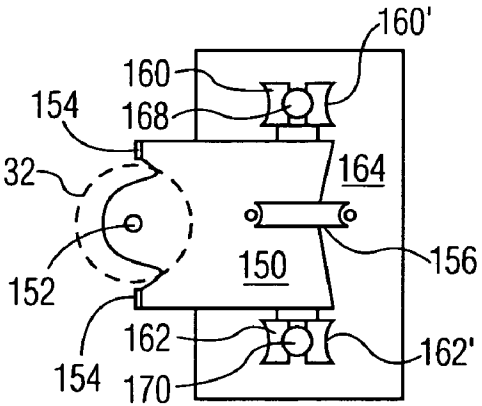
Figure 20:
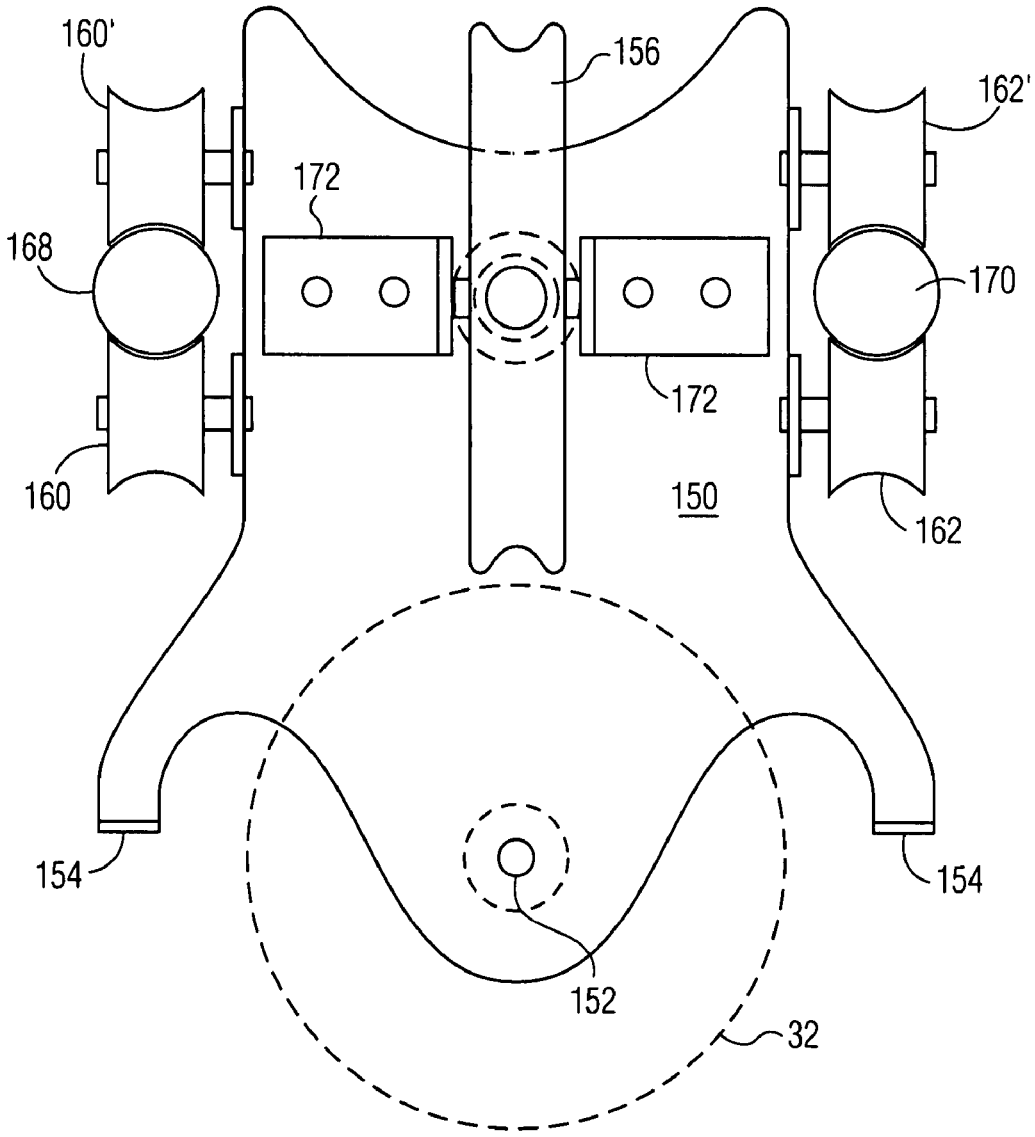
FIG. 20 is a detailed top view of the resistance source of FIG. 19.

FIGS. 19*a*, 19*b* and 19*c* show top, side and face views, respectively, of the resistance source for exercise apparatus of the type shown in either FIG. 17 or FIG. 18. This resistance source, which exerts a counterforce to the distal end of the cable when it is pulled, at its proximal end, by a user, includes a weight stack 164 having a plurality of weights 165. The user can select the number of weights to be lifted by placing a pin in one of the holes 166, locking the weight in which the pin is placed to a vertical lifting bar 167.

Arranged above the weight stack is a horizontal plate 150 which serves as a "retaining member" as will be described hereinbelow. The retaining member 150 is coupled to the distal end of the cable, in this example by means of a pulley 156. The retaining member 150 is also selectively coupled to the weight stack 164 in a manner which will be described in detail hereinbelow.

The retaining member 150 supports an upright cylindrical rod 152 for holding one or more additional and separate weights 32 of the type which are readily available at any fitness center or physical therapy facility.

In addition, the retaining member 150 is provided with two upstanding hooks 154 for attaching the upper ends of the two tension springs (elastic bands) 34. Similar hooks or eyes 155 are arranged at the bottom of the frame of the exercise apparatus for attaching the lower ends of the tension springs.

The weights 165 in a weight stack 164 are provided with holes 166 so that they may be retained and guided in their movement by two vertically arranged rods 168 and 170. These rods preferably have a round cross section and are about one inch in diameter.

The retaining member 150 is also smoothly guided in its vertical movement by means of rollers 160, 160', 162 and 162' on either side of the rods 168 and 170. This arrangement is shown in detail in FIGS. 20 and 21.

FIGS. 20-23 also illustrate how the pulley 156 is attached to the retaining member 150, by means of brackets 172, and illustrates how the retaining member 150 is selectively coupled to the bar 167, and therefore the weights 165 in the weight stack 164.

Figure 21:
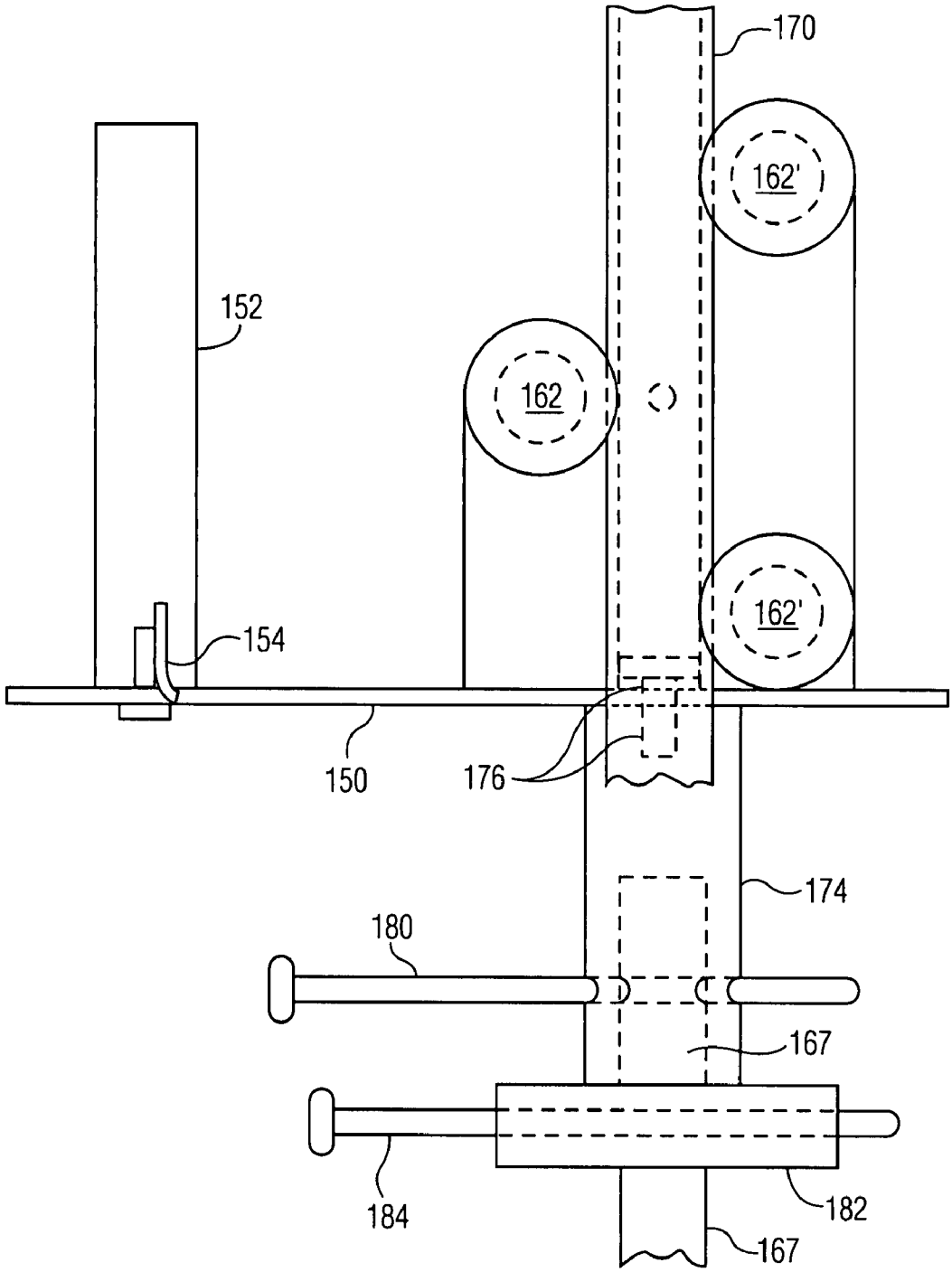
FIG. 21 is a detailed side view of the resistance source of FIG. 19.
Figure 22:
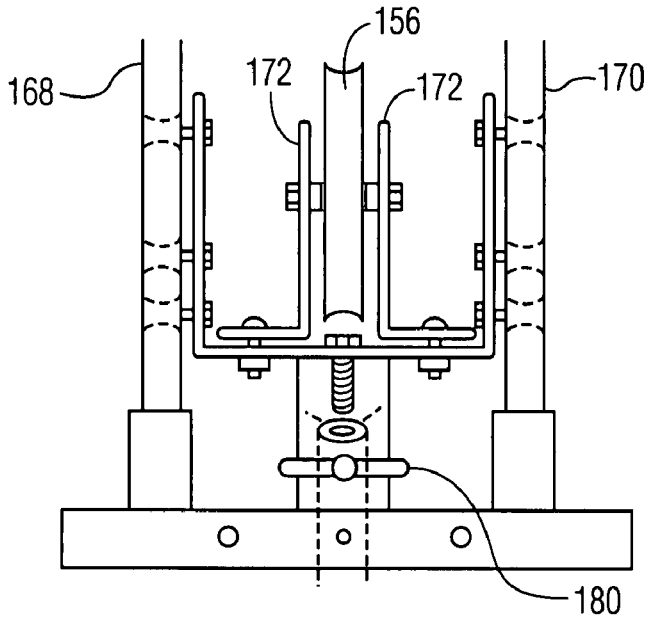
FIGS. 22 and 23 are detailed views of the coupling device in the resistance source of FIG. 19 in assembled and disassembled configurations, respectively.

As is best seen in FIG. 21, an also FIG. 23, a circular rod 174 is attached to the retaining member 150 by means of a screw 176. The rod 174 has a longitudinal opening 175 which accepts the circular rod 167 that extends downward and passes through the weight stack. A horizontal plate 182 serves as a limit stop for the downward movement of the rods 168 and 167.

When the rod 167 is inserted into the opening 175 in the rod 174, the two rods may be locked together by inserting a pin 180 through the aligned openings 183 and 184. With this pin 180 in place, upward movement of the retaining member 150 lifts the plate 182, the bar 167 and any of the weights in the weight stack which have been connected to it by inserting a pin through one of the weights and through an opening 166 in the bar 167.

FIGS. 24-26 illustrate still another arrangement for selectively attaching tension springs (elastic bands) 34 to the topmost weight 165 of the weight stack 164 and to the bottom of the frame of an exercise apparatus. The device comprises a top plate or bar 190 having an upstanding hook (or other attachment means) 192 at one end for attachment of a tension spring (elastic band) 34. The bar 190 is retained to the top weight 165 of the weight stack 164 by means of S-shaped clamps 194 that are secured by bolts 196 that pass through elongate slots 198 in the top plate.

The bottom (opposite end) of the tension spring (elastic band) 34 is attached to the frame with the aid of an U-shaped bracket 200 which is secured by a bolt 202. The bracket has an eye or a hook for attachment of the tension spring.

Figure 27:
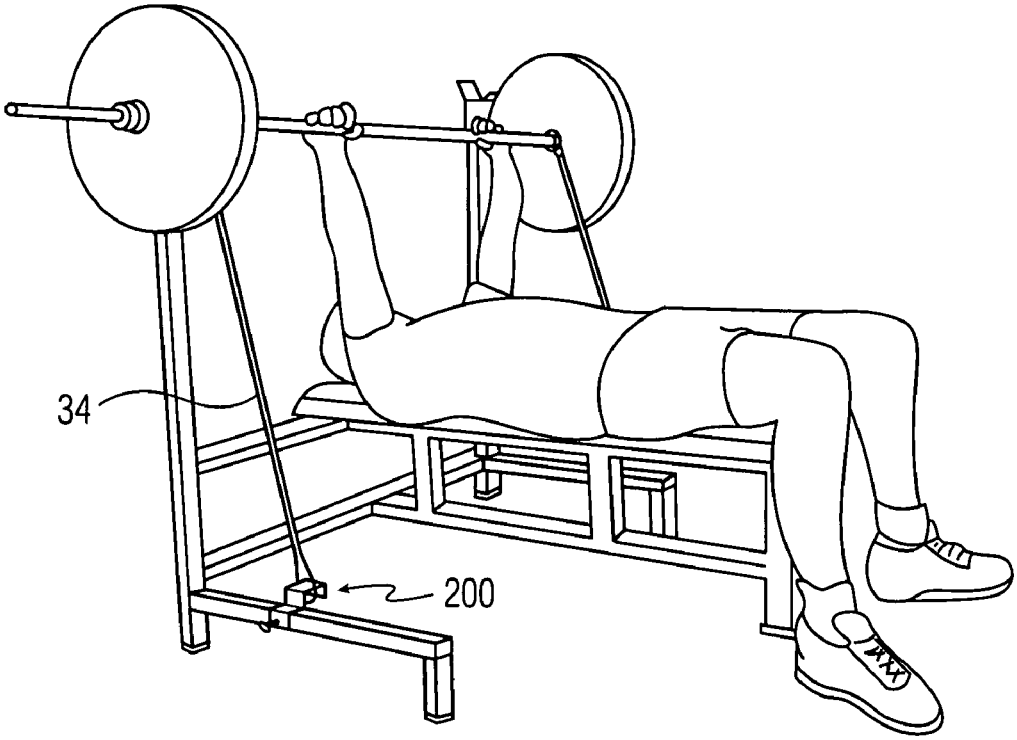
FIG. 27 is a perspective view showing how a universal attachment device shown in FIGS. 24-26 may be used in a bench press type of exercise apparatus.

FIG. 27 illustrates how the U-shaped bracket 200 may be used to permit attachment of tension springs (elastic bands) 34 to the frame of other types of exercise equipment.

Figure 28A:
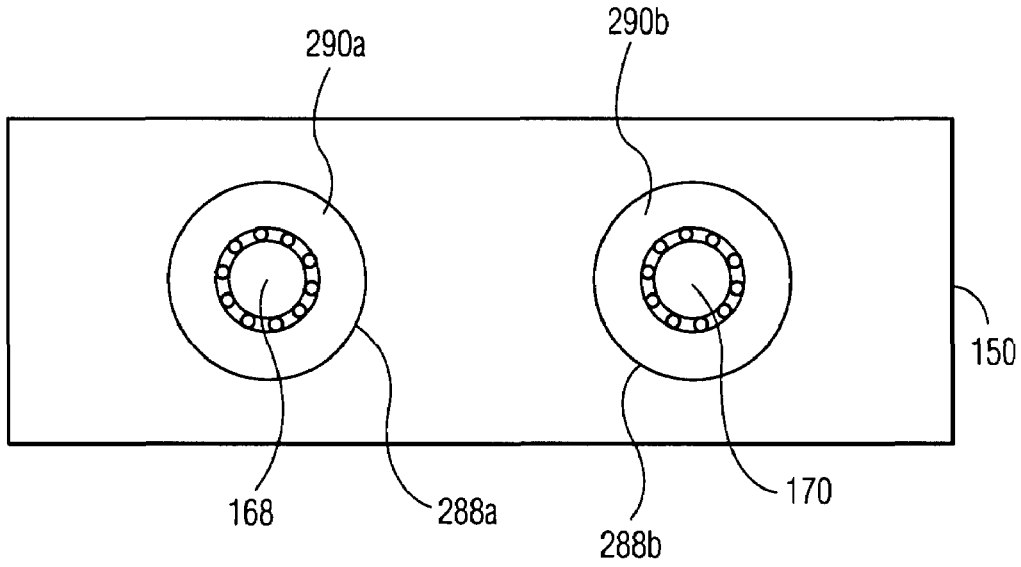
FIG. 28*a* illustrates a partial top view of the exercise apparatus of FIG. 18 in accordance with the present invention.

FIG. 28*a* illustrates a partial top view of the exercise apparatus of FIG. 18, in accordance with the present invention. The exercise apparatus includes a plate 150, one or more friction reducing devices 290, guide rod 168 and guide rod 170 and one or more holes 288. The guide rod 168 and guide rod 170 passes through the holes 288, such as a hole 288*a* and a hole 288*b*, respectively. The friction-reducing devices 290, such as a friction-reducing device 290*a* and a friction-reducing device 290*b* are mounted on guide rods 168 and 170, respectively. Details corresponding to plate 150, guide rod 168 and guide rod 170 have been explained in reference to FIG. 19 of the present invention.

One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Figure 28B:
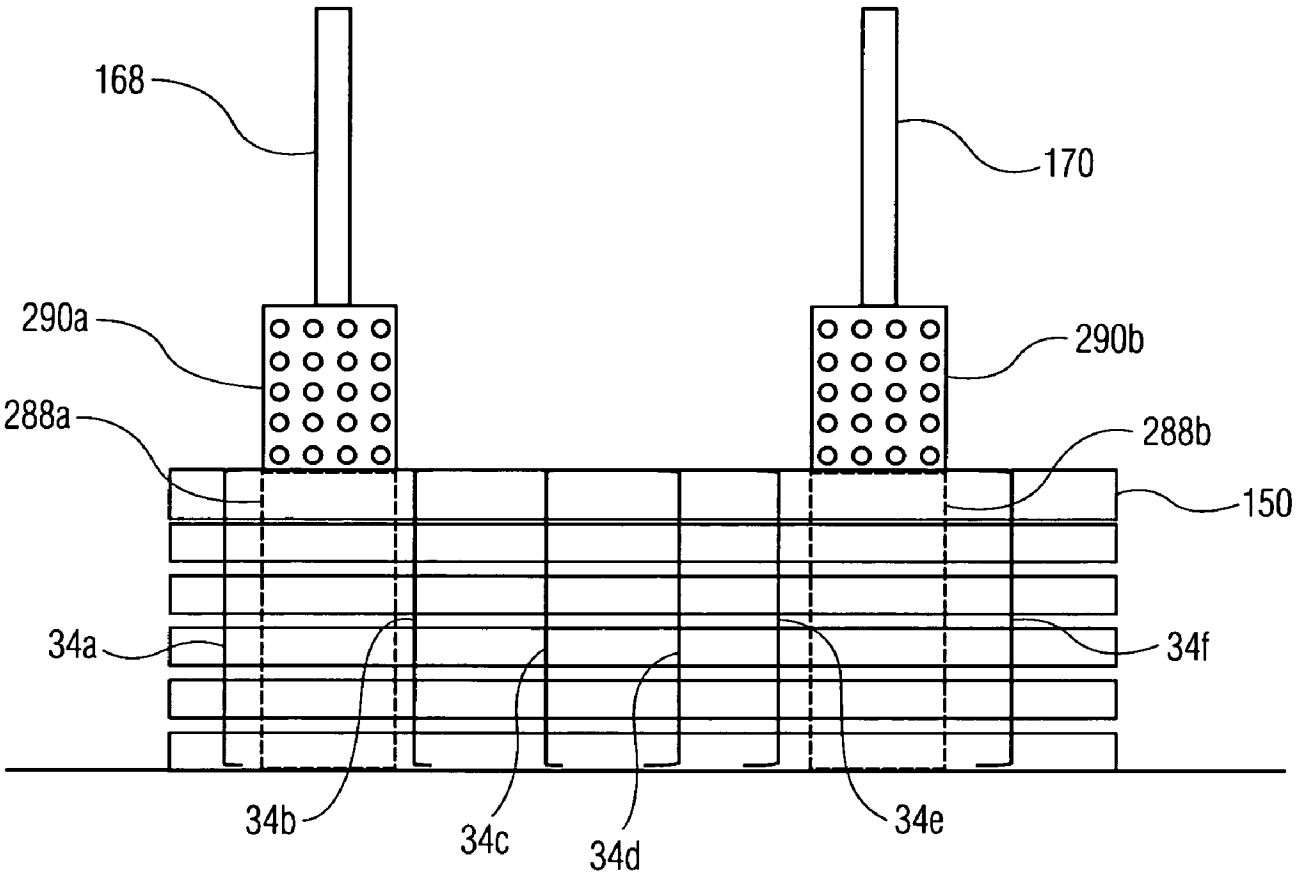
FIG. 28*b* illustrates a partial side view of the exercise apparatus of FIG. 18 in accordance with the present invention.

FIG. 28*b* illustrates a partial side view of the exercise apparatus of FIG. 18, in accordance with the present invention. The exercise apparatus includes one or more weights, the plate 150, the friction-reducing devices 290, the guide rod 168, the guide rod 170 and one or more springs 34. The weights are arranged in a weight stack. According to various embodiments of the present invention, the weight stack includes the holes 288.

The springs 34, such as springs 34*a*, 34*b*, 34*c*, 34*d*, 34*e* and 34*f* are attached to hooks formed on the plate 150. According to various embodiments of the present invention, the springs 34*a*, 34*b*, 34*c*, 34*d*, 34*e* and 34*f* are connected between the hooks and lowermost part of the housing of the exercise apparatus. Details corresponding to the plurality of springs 34 have been explained in reference to FIG. 18 of the present invention.

A cable includes a proximal end and a distal end. The distal end is coupled to a resistance source such that, when the proximal end of the cable is pulled by a user, the resistance source exerts a counter force on the cable. Details corresponding to the resistance source have been explained in reference to FIG. 5 and FIG. 7.

The guide rods 168 and 170 pass through the weight stack through the holes 288*a* and 288*b*, respectively. In an embodiment of the present invention, the guide rods 168 and 170 pass through the plate 150. The guide rods 168 and 170 constrain movement of the weights in the vertical direction.

Friction reducing devices 290*a* and 290*b* are mechanically coupled to the weights through holes 288*a* and 288*b*, respectively. The friction reducing devices 290*a* and 290*b* are mounted on guide rods 168 and 170, respectively, and are configured to roll on these guide rods 168 and 170. The weights thus move vertically on the guide rods 168 and 170 with the aid of the friction reducing devices 290*a* and 290*b*, respectively, that minimize friction between the weights and the guide rods 168 and 170. In an embodiment of the present invention, the friction reducing devices 290*a* and 290*b* are linear bearings with ball bearings. Examples of the friction reducing devices 290 include, but are not limited to, ball bearings, linear ball bearings and linear roller bearings.

A tensile force may be applied to the cable by a user by pulling the proximal end of the cable in any desired direction. For example, a user may pull a gripping device, attached at the proximal end of the cable, to exert the tensile force on the cable. The distal end of the cable is coupled to the resistance source, which exerts a resistance force on the distal end of the cable. Examples of the resistance source include, but are not limited to, one or more weights, tension springs, compression springs and dampers. Details corresponding to the resistance force, tension springs, compression springs and dampers have been explained in reference to FIG. 4, FIG. 7, and FIG. 11.

The vertical movement of the weights in the weight stack is based on the resistance force and the tensile force. For example, the weights move away from the lowermost part of the housing, when the tensile force is greater than the resistance force. However, the weights move towards the lowermost part of the housing when the tensile force is less than the resistance force. The movement of the weights leads to friction between the weights, and the guide rods 168 and 170. The friction is reduced by the friction reducing devices 290*a* and 290*b*.

There has thus been shown and described a novel exercise apparatus which may fulfill some or all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims.

What is claimed is:

1. An exercise apparatus comprising:

(a) a frame;

(b) a cable arranged in the frame, the cable comprising a proximal end and a distal end;

(c) a gripping device connected with the proximal end of the cable, the gripping device enabling a user to exert a tensile force on the cable in a desired direction;

(d) one or more substantially vertical guides attached to the frame;

(e) a resistance source coupled to the distal end of the cable, the resistance source exerting a counter force to the distal end as the proximal end of the cable is pulled by the user, said resistance source comprising:

(1) one or more weights arranged in a weight stack, said weights being arranged to move substantially vertically on said guides;

(2) a retaining member disposed above said weight stack and arranged to move substantially vertically on said guides, the retaining member coupled to the distal end of the cable and comprising at least two of:

(i) first means for removably attaching an upper end of at least one tension spring;

(ii) second means for retaining an additional source of resistance; and (iii) third means for selectively coupling to a plurality of weights in said weight stack;

(3) a fourth means disposed on the frame for removably attaching a lower end of said tension spring; and (f) a friction reducing device attached to said retaining member, said friction reducing device mechanically and rollingly coupling said retaining member to said guides, said friction reducing device being selected from the group consisting of:

(1) a linear ball bearing surrounding said guides;

(2) a linear roller bearing surrounding said guides; and (3) a device comprising a bracket and a plurality of rollers rotatably arranged thereon and adapted to roll along said guides;

whereby said friction reducing device minimizes friction between said retaining member and said guides.

2. The exercise apparatus recited in claim 1, wherein said cable is connected directly to said retaining member.

3. The exercise apparatus recited in claim 1, wherein said guides are one or more parallel rods extending through one or more vertical holes present in said retaining member and said weights, whereby said retaining member and said weights are constrained and guided by said parallel rods to move substantially vertically.

4. The exercise apparatus recited in claim 1, wherein said retaining member comprises a substantially horizontal plate.

5. The exercise apparatus recited in claim 1, wherein said retaining member further comprises a pulley through which said cable is passed at its distal end.

6. The exercise apparatus recited in claim 1, wherein said first means is a hook for removably attaching said tension spring.

7. The exercise apparatus recited in claim 1, wherein said tension spring is at least one elastic band.

8. The exercise apparatus recited in claim 1, wherein said tension spring includes an elongate spring member.

9. The exercise apparatus recited in claim 8, wherein said elongate member has a shape selected from the group consisting of a rod, a tube, a band, a strap and a flat strip.

10. The exercise apparatus recited in claim 1, wherein said tension spring is a coil spring.

11. The exercise apparatus recited in claim 1, wherein said second means is a rod adapted to be passed through a hole in a separate weight.

12. The exercise apparatus recited in claim 11, wherein said rod extends substantially vertically.

13. The exercise apparatus recited in claim 11, wherein said rod extends substantially horizontally.

14. The exercise apparatus recited in claim 1, wherein said fourth means is a hook for removably attaching said tension spring.

15. The exercise apparatus recited in claim 1, wherein said additional source of resistance is a damper.

16. The exercise apparatus recited in claim 15, wherein said damper is selected from the group consisting of a hydraulic damper, a pneumatic damper and an electromagnetic damper.

17. The exercise apparatus defined in claim 1, wherein said guides are rods of circular cross section, and said rollers are disposed on opposite sides of said rods.

18. The exercise apparatus recited in claim 1, wherein said second means is a substantially horizontal bar, adapted to be inserted in an opening in one or more weights, for removably holding said one or more weights.

19. The exercise apparatus recited in claim 1, wherein said second means is a substantially horizontal surface upon which one or more weights may be placed, for removably holding said one or more weights.

20. Exercise apparatus having a frame and a stack of weights comprising, in combination:

(1) a first device for removably connecting a tension spring to a topmost weight in said weight stack, said first device comprising:

(a) an elongate bar having means for attachment of one end of said tension spring, said bar being adapted to extend across, and to be clamped onto, a top surface of said topmost weight, said bar having at least one hole therein;

(b) at least one S-shaped clamp adapted to be inserted between said topmost weight and a lower weight in said weight stack, said clamp having at least one hole therein;

(c) a bolt, adapted to be passed through said openings in said bar and said clamp, for securing said bar and said clamp together; and (2) a second device for removably connecting an opposite end of said tension spring to the frame, said second device comprising:

(a) an U-shaped bracket having a threaded hole therein, and means for attachment of said opposite of said tension spring; and (b) a threaded bolt inserted in said hole, the threads of said bolt mating with the threads of said hole, to clamp the U-shaped bracket to the frame member.

* * * * *